US010540945B2

(12) United States Patent
Upton

(10) Patent No.: US 10,540,945 B2
(45) Date of Patent: Jan. 21, 2020

(54) PACKABLE STRINGED INSTRUMENT

(71) Applicant: Upton Bass String Instrument Co., Mystic, CT (US)

(72) Inventor: Gary Upton, Niantic, CT (US)

(73) Assignee: Upton Bass String Instrument Co., Mystic, CT (US)

( * ) Notice: Subject to any disclaimer, the term of this patent is extended or adjusted under 35 U.S.C. 154(b) by 0 days.

(21) Appl. No.: 16/249,618

(22) Filed: Jan. 16, 2019

(65) Prior Publication Data

US 2019/0221194 A1 Jul. 18, 2019

Related U.S. Application Data

(60) Provisional application No. 62/709,369, filed on Jan. 16, 2018.

(51) Int. Cl.

| | |
|---|---|
| ***G10D 1/02*** | (2006.01) |
| ***G10D 3/00*** | (2006.01) |
| ***G10D 3/04*** | (2006.01) |
| ***G10D 3/06*** | (2006.01) |

(52) U.S. Cl.

CPC ..... *G10D 1/02* (2013.01); *G10D 3/003* (2013.01); *G10D 3/04* (2013.01); *G10D 3/06* (2013.01)

(58) Field of Classification Search

CPC ..... G10D 1/02; G10D 3/003; G10D 3/04; G10D 3/06

See application file for complete search history.

(56) References Cited

U.S. PATENT DOCUMENTS

| | | | | |
|---|---|---|---|---|
| 2,464,100 A * | 3/1949 | Ruggiero | ..... | G10D 1/02 84/275 |
| 2,803,982 A | 8/1957 | Gassin et al. | | |
| 4,073,211 A * | 2/1978 | Jorgensen | ..... | G10D 1/08 84/267 |

(Continued)

FOREIGN PATENT DOCUMENTS

| | | | |
|---|---|---|---|
| CN | 204650979 | U | 9/2015 |
| EP | 2725573 | A1 | 4/2014 |
| WO | 2014167272 | A2 | 10/2014 |

OTHER PUBLICATIONS talk bass.com, The Patrick Charton suit-bass, video on the web dated Jun. 28, 2017, 14 pgs., https://www.talkbass.com/threads/the-patrick-charton-suit-bass.1291721/.

(Continued)

*Primary Examiner* — Robert W Horn

(74) *Attorney, Agent, or Firm* — Moyles IP, LLC

(57) ABSTRACT

Exemplary embodiments of packable stringed instruments, such as upright basses, are disclosed. The exemplary embodiments include a segmented body portion, a neck portion, and a head portion, wherein respective segments of the segmented body portion are removably secured to each other and the neck portion. The segmented body portion may include, for example, an upper body (UB) portion, a lower body (LB) portion, and a central body portion. The neck portion may be separable from the head portion. The various components of the packable stringed instrument are complimentarily shaped so as to be condensed for storage and/or transport. Exemplary methods for disassembling and assembling the exemplary packable stringed instruments are also disclosed.

20 Claims, 23 Drawing Sheets

(56) References Cited

U.S. PATENT DOCUMENTS

| | | | | | |
|---|---|---|---|---|---|
| 4,111,093 | A * | 9/1978 | Field | G10D 1/08 | 84/267 |
| 4,191,085 | A * | 3/1980 | Litwin | G10D 3/06 | 84/291 |
| 4,573,391 | A * | 3/1986 | White | G10D 1/08 | 84/291 |
| 4,638,708 | A * | 1/1987 | Kamal | G10D 3/06 | 84/293 |
| 5,233,896 | A * | 8/1993 | Worthington | G10D 3/06 | 84/293 |
| 5,353,672 | A * | 10/1994 | Stewart | G10D 3/06 | 84/267 |
| 5,383,385 | A | 1/1995 | Gilbert | | |
| 5,390,578 | A * | 2/1995 | Raymer | G10D 1/085 | 84/267 |
| 5,949,005 | A * | 9/1999 | Peterson | G10D 1/085 | 84/267 |
| 6,025,548 | A * | 2/2000 | Ehrlich | G10D 1/08 | 84/267 |
| 6,353,164 | B1 * | 3/2002 | Corsi | G10D 3/06 | 84/290 |
| 6,911,590 | B2 * | 6/2005 | Childress | G10D 1/00 | 84/291 |
| 7,112,732 | B2 | 9/2006 | Tamura | | |
| 7,652,205 | B2 * | 1/2010 | Leach | G10D 1/08 | 84/267 |
| 7,696,419 | B2 * | 4/2010 | Chadwick V | G10D 1/08 | 84/173 |
| 7,705,224 | B1 * | 4/2010 | Ward | G10D 1/08 | 84/267 |
| 7,872,185 | B1 * | 1/2011 | Chadwick | G10D 1/08 | 84/275 |
| 8,203,058 | B2 * | 6/2012 | Leach | G10D 1/08 | 84/267 |
| 8,273,974 | B1 | 9/2012 | Gonzalez | | |
| 8,927,836 | B1 | 1/2015 | Birkhamshaw | | |
| 8,952,230 | B2 * | 2/2015 | Bailey, II | G10D 3/06 | 84/293 |
| 9,454,947 | B1 | 9/2016 | Hart et al. | | |
| 9,514,719 | B1 * | 12/2016 | Ward | G10D 1/08 | |
| 9,721,543 | B1 | 8/2017 | White | | |
| 2004/0099122 | A1 | 5/2004 | McPherson | | |
| 2010/0024623 | A1 | 2/2010 | Kim | | |
| 2012/0255418 | A1 * | 10/2012 | Hart | G10D 1/005 | 84/275 |
| 2019/0221194 | A1 * | 7/2019 | Upton | G10D 1/02 | |

OTHER PUBLICATIONS

International Search Report and Written Opinion of International App. No. PCT/US2019/013855, dated May 6, 2019, which is in the same family as U.S. Appl. No. 16/249,618, 19 pgs.

Geigenbaumeister Dominik Hufnagl, Der Reisebass, in German , Dec. 2012, 2 pgs., http://www.bassbau.de/neu/index.php?DOC_INST=26.

* cited by examiner

PACKABLE STRINGED INSTRUMENT

CROSS-REFERENCE TO RELATED APPLICATIONS

This application claims the benefit of U.S. Provisional Patent Application No. 62/709,369 filed Jan. 16, 2018, the entire contents of which are incorporated herein by reference.

FIELD OF THE DISCLOSURE

This disclosure is directed generally to packable stringed instruments, and in particular a packable upright bass.

BACKGROUND OF THE DISCLOSURE

Certain stringed instruments may be large, bulky, or oddly shaped. For example, upright basses are particularly large and bulky instruments. An upright bass may be as tall, or taller, than a musician that plays it. Further, upright basses typically have a large, hollow body for producing a deep, rich sound, and a long neck and fingerboard for providing the musician with access to the full pitch range of the instrument. FIG. 19 shows a typical upright bass 1900 as described in U.S. Pat. No. 7,872,185.

The sheer size and tuning sensitivity of these instruments make storing and traveling with them cumbersome and expensive. An upright bass is typically stored in a case 2000 that is at least as big as the instrument, as shown in FIG. 20. Stresses on the instrument may cause deformation of the strings and associated parts, damage to the instrument, and temporary or permanent degradation of the sound quality. In addition, environmental conditions such as temperature, temperature swings, and humidity can warp various components of the instrument. These and other considerations present certain limitations for condensing, storing, and transporting an upright bass.

Further, many musicians travel with these instruments. A musician may prefer to play her or his own instrument and must therefore transport the instrument no matter the means or distance of travel. As such, the musician may encounter difficulties in fitting the instrument in a vehicle or carrying the instrument through busy travel areas such as airports, trains, and train stations. In addition, airlines in particular may charge fees for instruments that are over luggage size restrictions.

In addition to upright basses, these and other considerations may be applicable to stringed instruments such as cellos, violins, bass violins, violas, guitars, and the like.

While a methodology and device is known for providing a removable neck of such instruments, and thus increasing the packability thereof, the carrying case 2100 remains quite large, as can be seen in FIG. 21. Accordingly, packable stringed instruments and methods for assembling and disassembling the instruments, especially upright basses, are needed. An exemplary packable instrument and method may allow the instrument to be disassembled for travel and storage without sacrificing the sound quality or playability of the instrument.

BRIEF DESCRIPTION OF THE EXEMPLARY EMBODIMENTS

According to an aspect, the exemplary embodiments may be associated with packable stringed instruments, and packable upright basses. More specifically, the exemplary disclosed embodiments include a packable stringed instrument, including: a head portion; a segmented body portion, wherein the segmented body portion includes at least a first segment, a second segment, and a central body portion, wherein the central body portion is positioned between the first segment and the second segment; and, a neck portion positioned between the head portion and the segmented body portion, wherein the neck portion includes a first end and a second end, wherein the first end of the neck portion is connected to the head portion, and the second end of the neck portion is connected to the segmented body portion. In an aspect, one or more removable fasteners may removably secure each of the head portion to the first end of the neck portion, the segmented body portion to the second end of the neck portion, the first segment of the body portion to the central body portion, and the second segment of the body portion to the central body portion.

The exemplary embodiments may also include a packable stringed instrument, including: a head portion; a body portion, wherein the body portion includes at least one upper body (UB) portion, at least one lower body (LB) portion, and a central body portion, wherein the central body portion is positioned between the UB portion and the LB portion, and each of the UB portion and the LB portion is removably connected to the central body portion; and, a neck portion, wherein the neck portion includes a first end and a second end, wherein the first end of the neck portion is connected to the head portion, and the second end of the neck portion is connected to the body portion. In an aspect, the central body portion may be an integral unit including a central front face panel, a central rear face panel, and a central sidewall together defining a hollow cavity, wherein the central sidewall extends between at least a portion of the central front face panel and the central rear face panel. In a further aspect, the UB portion includes a front face panel and a rear face panel, and the LB portion includes a front face panel and a rear face panel, and each rear face panel is removably to secured to at least one of the corresponding body portion and the central body portion.

In still further aspects, the neck portion of certain exemplary packable stringed instruments is removably secured to each of the body portion and the head portion. In certain embodiments, the head portion and the neck portion may be removably secured by at least one removable fastener. In the same or other embodiments, the head portion and neck portion may be removably secured by a tension created by strings on the packable stringed instrument. In other exemplary embodiments, the head portion and the neck portion are integrally joined. Moreover, the neck portion may be joined to the body portion by a neck connecting assembly on the neck portion and a corresponding connecting block on the body portion.

The exemplary disclosed embodiments additionally include associated embodiments of a method for disassembling a packable stringed instrument, the method including: removing a tailpiece from a body portion of the stringed instrument; removing a neck portion of the stringed instrument from the body portion of the stringed instrument; removing a head portion of the stringed instrument from the neck portion; and, removing from each other at least an upper body (UB) segment of the body portion, a lower body (LB) segment of the body portion, and a central body portion. In an aspect, removing the tailpiece from the body portion releases a tension created by strings on the instrument, wherein the tension may removably secure at least the head portion to the neck portion. In another aspect, removing two or more components from each other includes removing at least one removable fastener that removably secures the components.

The exemplary devices, systems, and methods may further include a packable stringed instrument that is shaped to allow various removable components to be consolidated, e.g., stacked, for storage and/or transport. In an aspect, the exemplary embodiments may include a complimentary carrying case, and a method for arranging the removable components in the carrying case. In another aspect, the exemplary disclosed embodiments include corresponding devices, systems, and methods for unpacking and assembling a packable stringed instrument.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
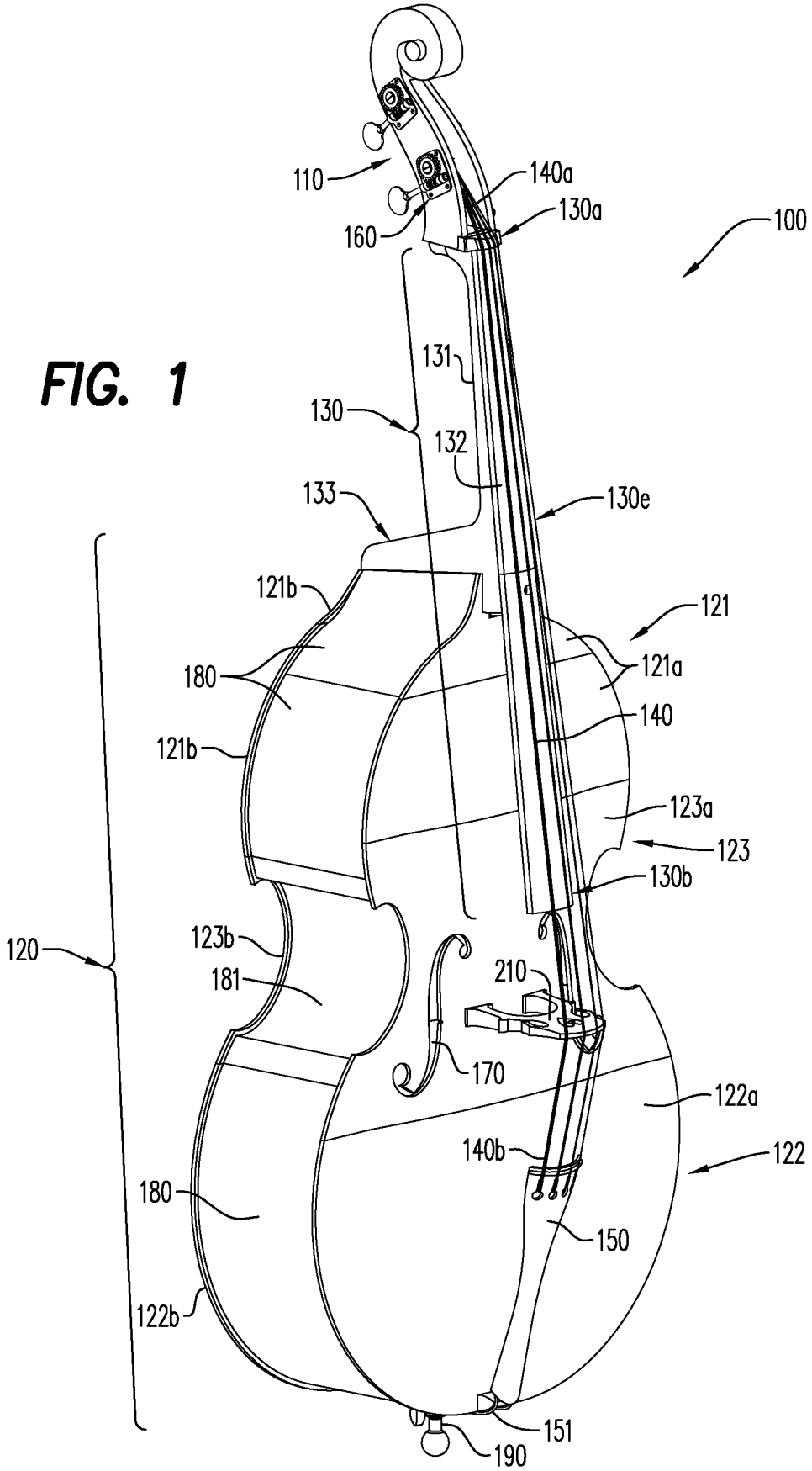
FIG. 1 is a perspective view of an exemplary packable upright bass including a head portion, a neck portion, and a body portion in an assembled state, according to the disclosure.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation, and is not meant as a limitation and does not constitute a definition of all possible embodiments.

For purposes of this disclosure, the phrases "device(s)", "system(s)", and "method(s)" may be used either individually or in any combination referring without limitation to disclosed components, grouping, arrangements, steps, functions, or processes.

For purposes of illustrating features of the embodiments, an example will now be introduced and referenced throughout the disclosure. This example is illustrative and not limiting, and is provided purely for explanatory purposes.

With reference now to FIG. 1, an exemplary embodiment of a packable stringed instrument 100 is shown. In the exemplary embodiment, the packable stringed instrument 100 is an upright bass. As shown in FIG. 1, the exemplary packable upright bass 100 includes, among other things, a head portion 110, a body portion 120, and a neck portion 130 extending between the head portion 110 and the body portion 120. A first end 130*a* of the neck portion 130 is connected to the head portion 110, and a second end 130*b* of the neck portion 130 is configured to abut a portion of the body portion 120, as described further below, while a middle 130*e* of the neck portion 130 is configured to attach the neck portion 130 to the body portion 120. At least one string 140 is connected at a first end 140*a* of the string 140 to the head portion 110, and at a second end 140*b* of the string 140 to a tailpiece 150 that is removably secured to the body portion 120. Typically, an upright bass will include four strings 140 attached as described to the head portion 110 and the tailpiece 150, wherein each string 140 has a different pitch. The neck portion 130 includes a fingerboard 132, wherein the fingerboard 132 defines a surface of the neck portion 130 that faces the strings 140. The fingerboard 132 is attached to or formed in a neck body 131, wherein the neck body 131 defines a surface of the neck portion 130 that faces away from the strings 140, opposite the fingerboard. In the exemplary embodiment shown in FIG. 1, the neck portion 130 is removably secured to the body portion 120 by a neck assembly which is described with respect to FIG. 10. The neck assembly includes heel 133 at about the middle 130*e* of the neck portion, which provides support and an aesthetic contour to the connection between the neck portion 130 and the body portion 120. A bridge 210 elevates the strings 140 between the neck portion 130 and the tailpiece 150, and thereby elevates the strings 140 above the fingerboard 132. In use, a musician causes one or more strings 140 to vibrate by, e.g., plucking, slapping, striking, or rubbing a bow across the strings 140, while holding the vibrating string(s) 140 against the fingerboard 132. The distance between the vibrating portion of the string 140 and the position at which the musician holds the string 140 against the fingerboard 132 determines in part the pitch, or musical note, that is produced by the vibrating string(s) 140. In the exemplary upright bass 100, as with conventional upright basses and other stringed instruments, the body portion 120 has a hollow interior 410 (FIG. 4) in which the sounds produced by the strings 140 resonate and become amplified. F-holes (or sound holes) 170 provide a sound communication channel between the hollow interior 410 of the body portion 120 and the outside of the instrument.

In an aspect, the first end 140*a* of each string 140 is attached to a string connector 160 (e.g., machine head) on the head portion 110, and, in the exemplary embodiments, the string connector 160 is a gear and post mechanism including a tuning peg. Tuning pegs are known components of stringed instruments and are used to tune the instruments by adjusting a tension, and thereby a pitch, of the strings that are coiled around the tuning pegs. Releasing the coil/tension of the strings from the tuning pegs also loosens the strings with respect to the neck portion 130 and the body portion 120 of the instrument. The string connector/tuning pegs 160 are further shown in FIGS. 12A and 12B.

Continuing with reference to FIG. 1, the body portion 120 of the exemplary packable upright bass 100 is a segmented body portion 120 including at least an upper body (UB) portion (e.g., an upper bout) 121, a lower body (LB) portion (e.g., a lower bout) 122, and a central body portion (e.g., a C bout) 123. The central body portion 123 is positioned between the UB portion 121 and the LB portion 122. The UB portion 121, LB portion 122, and central body portion 123 are removably secured in an assembled state such as shown in FIG. 1, and are separable from each other so as to be reversibly disassembled to a disassembled state (see FIGS. 16 and 17). The UB portion 121, the LB portion 122, and the central body portion 123 are complimentarily shaped to be stacked in the disassembled state, so as to form a stack such as stack 1810 (FIG. 18B). FIGS. 18A and 18B show an exemplary embodiment of the packable upright bass 100 in an exemplary disassembled state, wherein the separated components of the packable upright bass 100 are being packed into a suitcase/carrying case 1800, as described further below.

With further reference to the exemplary packable upright bass 100 shown in FIG. 1, the UB portion 121 includes at least one front face panel 121*a*, at least one rear face panel 121*b*, and at least one sidewall (e.g., the ribs) 180, wherein the sidewall 180 extends between at least a portion of the front face panel 121*a* of the UB portion 121 and at least a portion of rear face panel 121*b* of the UB portion 121. The front face panel 121*a*, the rear face panel 121*b*, and the sidewall 180 of the UB portion 121 together define a hollow cavity 125 (see FIG. 6A) of the UB portion 121. In the exemplary embodiment shown in FIG. 1, the UB portion 121 includes two front face panels 121*a*.

The LB portion 122 includes at least one front face panel 122*a*, at least one rear face panel 122*b*, and at least one sidewall 180, wherein the sidewall 180 extends between at least a portion of the front face panel 122*a* of the LB portion 122 and at least a portion of the rear face panel 122*b* of the LB portion 122. The front face panel 122*a*, the rear face panel 122*b*, and the sidewall 180 of the LB portion 122 together define a hollow cavity 126 (see FIG. 4) of the LB portion 122. In the exemplary embodiment shown in FIG. 1, the LB portion 122 includes one front face panel 122*a* and one rear face panel 122*b*. In the same or other embodiments, each of the UB portion 121 and LB portion 122 may include any number of front face panels 121*a*, 122*a* and rear face panels 121*b*, 122*b* in any configuration consistent with the spirit and scope of this disclosure. In certain embodiments, at least one of the UB portion 121 and the LB portion 122 may be an integral unit, wherein the respective front face panel(s) 121*a*, 122*a*, rear face panel(s) 121*b*, 122*b*, and sidewall(s) 180 of the integral unit(s) are integrally or rigidly joined. In the same or other embodiments, at least a portion of at least one of the UB portion 121 and the LB portion 122 may be removable from the associated UB portion 121 and LB portion 122.

The central body portion 123 includes at least one central front face panel 123*a*, at least one central rear face panel 123*b*, and at least one central sidewall 181, wherein the central sidewall 181 extends between at least a portion of the central front face panel 123*a* and at least a portion of the central rear face panel 123*b*. The central front face panel 123*a*, the central rear face panel 123*b*, and the central sidewall 181 (shown in FIG. 8 as having a left central sidewall 181*a* and a right central sidewall 181*b*) together define a hollow cavity 124 (see FIG. 8) of the central body portion 123. The hollow cavities 124, 125, 126 respectively of the central body portion 123, the UB portion 121, and the LB portion 122 together define a hollow interior 410 (see FIGS. 4 and 7*a*) of the body portion 120 in an assembled state. In the exemplary embodiment(s) shown in, e.g., FIGS. 1 and 8, the central body portion 123 is an integral unit in which the central front face panel 123*a*, the central rear face panel 123*b*, and the central sidewall 181 are integrally or rigidly joined. In other embodiments, at least a portion of the central body portion 123, such as, among other things, the central front face panel 123*a*, the central rear face panel 123*b*, and the central sidewall 181, may be removable from the central body portion 123. While not wishing to be bound by the theory, it is believed that forming the central body portion 123 as an integral unit provides the best sound quality for the instrument.

The head portion 110, the body portion 120, the neck portion 130, and the associated components of the exemplary disclosed embodiments of a packable stringed instrument/upright bass 100 are formed generally from known materials that are used in like instruments. For example, the head portion 110, the body portion 120, and the neck portion 130 may be formed from natural or artificial wood, such as spruce, maple, plywood, fiberboard, etc., and may be laminated or fully carved (without any lamination). The fingerboard 132 may be formed from ebony, and the neck portion 130 may be supported by carbon fiber rods within the neck portion 130 and/or connecting segments (i.e., 130*c*, 130*d* (see FIG. 15)) of the neck portion 130. Other materials are known, and may include, for example and without limitation, plastics, metals such as aluminum or steel alloys, composite materials, hard rubbers, ceramics, etc. The exemplary disclosed devices, systems, and methods are not generally limited by the materials of construction.

Figure 13A:
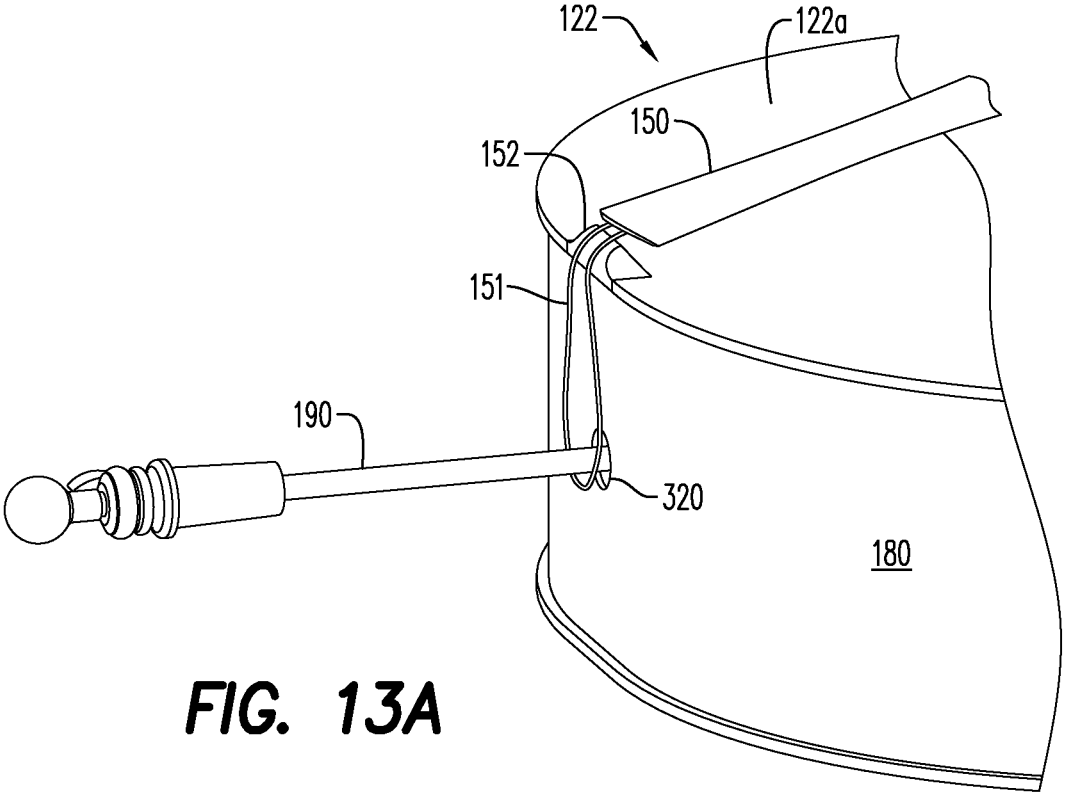
FIG. 13A shows a stand being removed from the body portion as part of an exemplary method for disassembling a packable stringed instrument.

Returning to FIG. 1, the exemplary packable upright bass 100 further includes a stand 190 for elevating the instrument during playing and preventing potential damage to the body portion 120 from contacting the ground/playing surface. As shown and described with respect to FIG. 13A, the stand 190 extends through a stand aperture 320 in the sidewall 180 into the hollow cavity 126 of the LB portion 122 (see also FIGS. 3 and 4). A string retaining saddle strap 151 in the exemplary embodiment(s) connects at a first end to the tailpiece 150 and loops around the stand 190 at a second end, to create a tension that removably secures the tailpiece 150 to the body portion 120. The string retaining saddle strap 151 extends over a saddle 152 (see FIG. 13A) that supports the string retaining saddle strap 151 over the body portion, between the tailpiece 150 and the stand 190. In an associated exemplary method for disassembling the packable stringed instrument 100, described below, the stand 190 is removable from the instrument 100, thereby releasing the string retaining saddle strap 151 such that the tailpiece 150 and strings 140 may be removed from the body portion 120.

Figure 2:
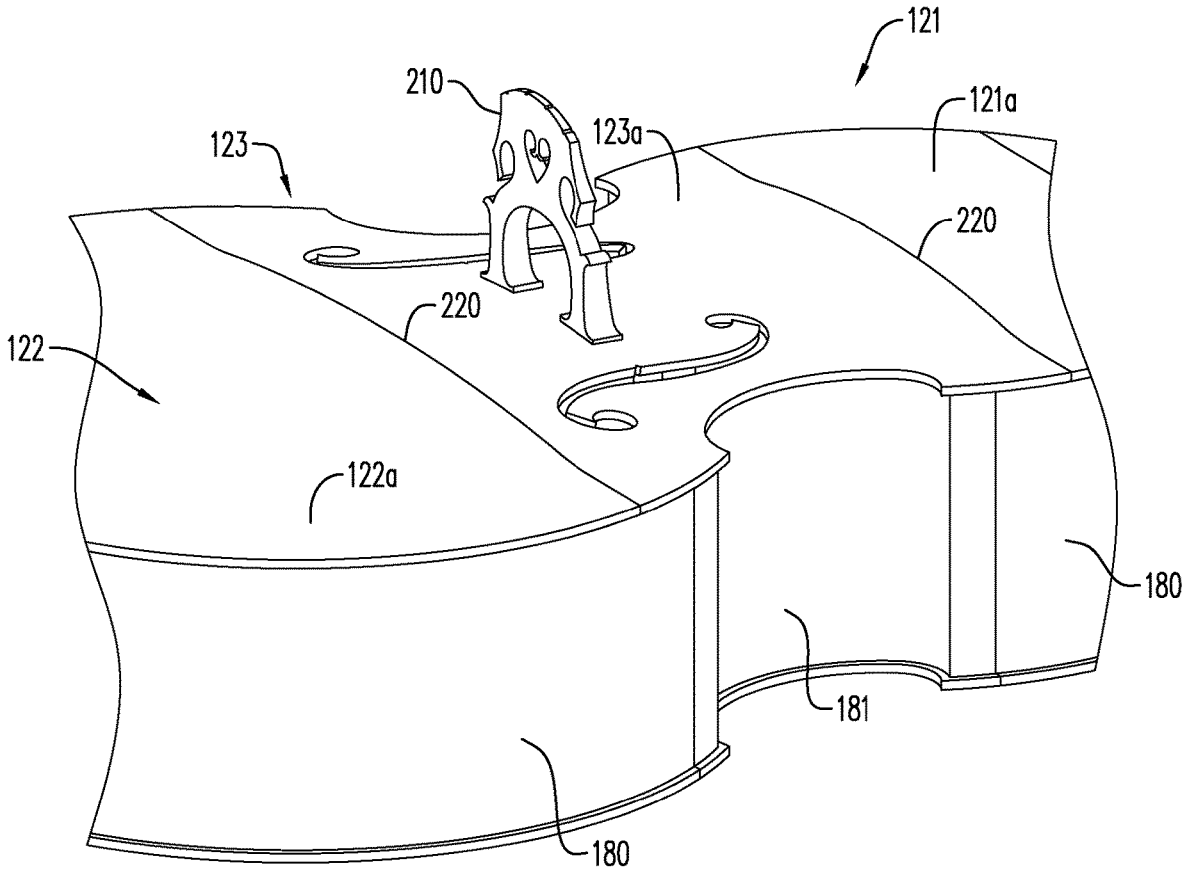
FIG. 2 shows a partial side perspective view of a front face panel of an upper body (UB) portion, a front face panel of a lower body (LB) portion, and a central front face panel of a central body portion of the exemplary packable upright bass.

With reference now to FIG. 2, the front face panels 121*a*, 122*a*, 123*a* of the UB portion 121, the LB portion 122, and the central body portion 123 respectively are shown in an assembled state. In the exemplary embodiment shown in FIG. 2, the UB portion 121 has one front face panel 121*a*. Further, as discussed with respect to FIGS. 7A and 7B, the exemplary UB portion 121, LB portion 122, and central body portion 123 are removably secured to each other in part within the hollow cavity 410 of the body portion 120. Accordingly, the respective front face panels 121*a*, 122*a*, 123*a* of the UB portion 121, the LB portion 122, and the central body portion 123 form seams 220 in the assembled state. In the exemplary embodiment, the respective sidewalls 180 of the UB portion 121 and the LB portion 122 are rigidly secured to the corresponding front face panels 121*a*, 122*a* In other embodiments, one or more sidewalls 180 may be integral with, or removably secured to, at least one of the front face panels 121*a*, 122*a* of the UB portion 121 and the LB portion 122. In addition, the respective sidewalls 180 of the UB portion 121 and LB portion 122 are shaped to continue a contour of the central sidewall 181.

Figure 3:
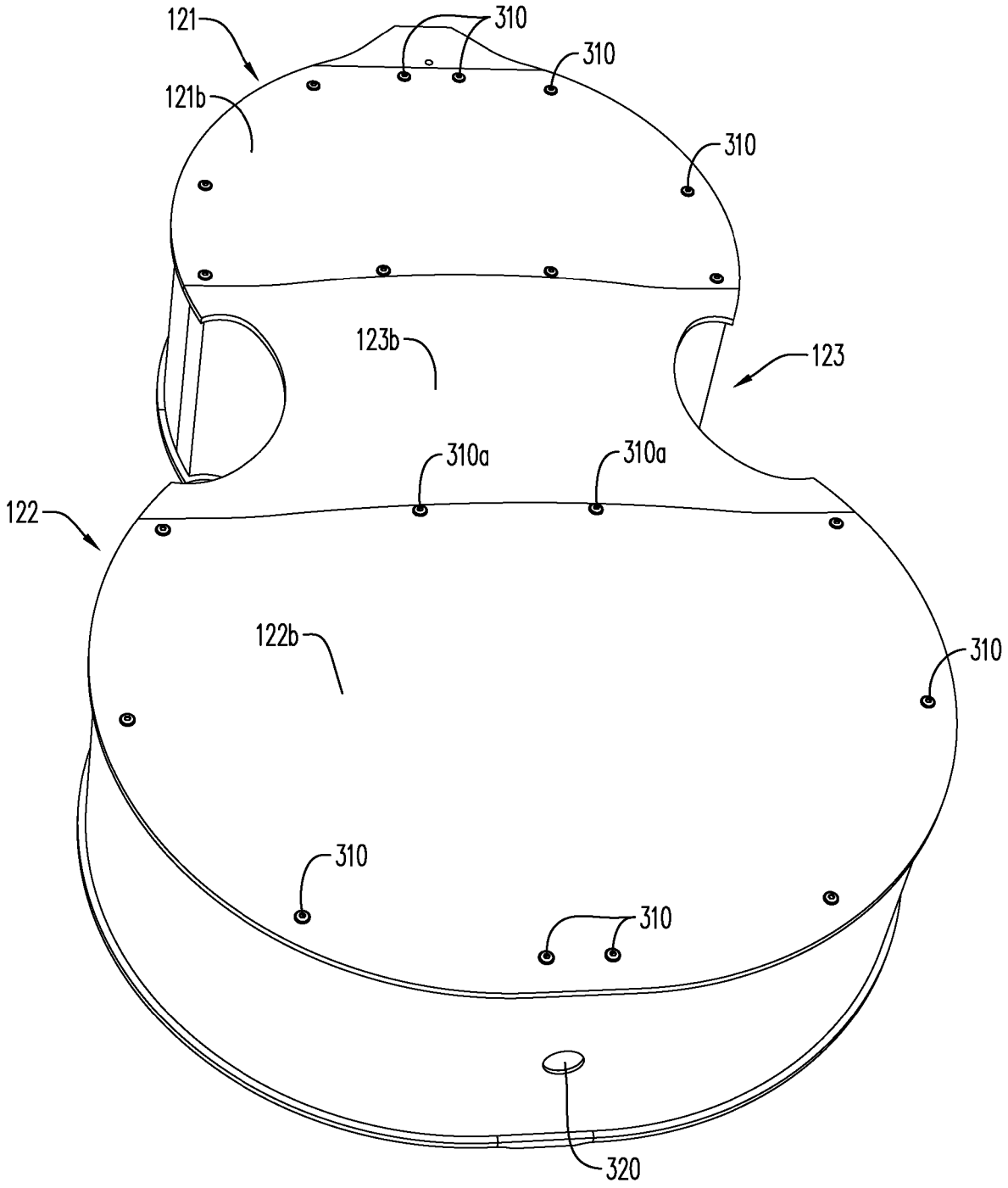
FIG. 3 shows a perspective view of a rear face panel of the UB portion, a rear face panel of the LB portion, and a central rear face panel of the central body portion.

With reference now to FIG. 3, the respective rear face panels 121*b*, 122*b*, 123*b* of the UB portion 121, the LB portion 122, and the central body portion 123 are shown in an assembled state. In the exemplary embodiment shown in FIG. 3, the respective rear face panels 121*b*, 122*b* of the UB portion 121 and the LB portion 122 are removably secured to the UB portion 121 and the LB portion 122. The central body portion 123 is an integral unit and is connected to the UB portion 121 and LB portion 122 as described below with respect to FIGS. 6A-7B. The respective rear face panels 121*b*, 122*b* of the UB portion 121 and the LB portion 122 are removably secured to the corresponding body segments 121, 122 by removable fasteners 310 (see FIG. 3) that extend between the rear face panels 121*b*, 122*b* and connecting blocks 420 (see FIG. 4) within the hollow interior 410 of the body portion 120, through apertures 510 (see FIG. 5). Each rear face panel 121*b*, 122*b* is also removably secured to the central rear face panel 123*b* by removable central fasteners 310*a* that extend between the rear face panels 121*b*, 122*b* and respective central fastener receiving cavities 611 (see FIGS. 6A and 6B) on an upper lip 610*a* and a lower lip 610*b* of the central rear face panel 123*b*, through central apertures 510*a* (see FIGS. 5, 6B) in the rear face panels 121*b*, 122*b*, as described below. As described below with respect to an associated method for disassembling the packable stringed instrument 100, the removable fasteners 310 may be removed from the rear face panels 121*b*, 122*b* so as to separate the respective rear face panels 121*b*, 122*b* from the UB portion 121 and the LB portion 122. The removable fasteners 310, 310*a* also serve to resist a folding tension of the strings 140 that is pulling each of the UB portion 121 and LB portion 122 towards the central front face panel 123*a*.

Figure 4:
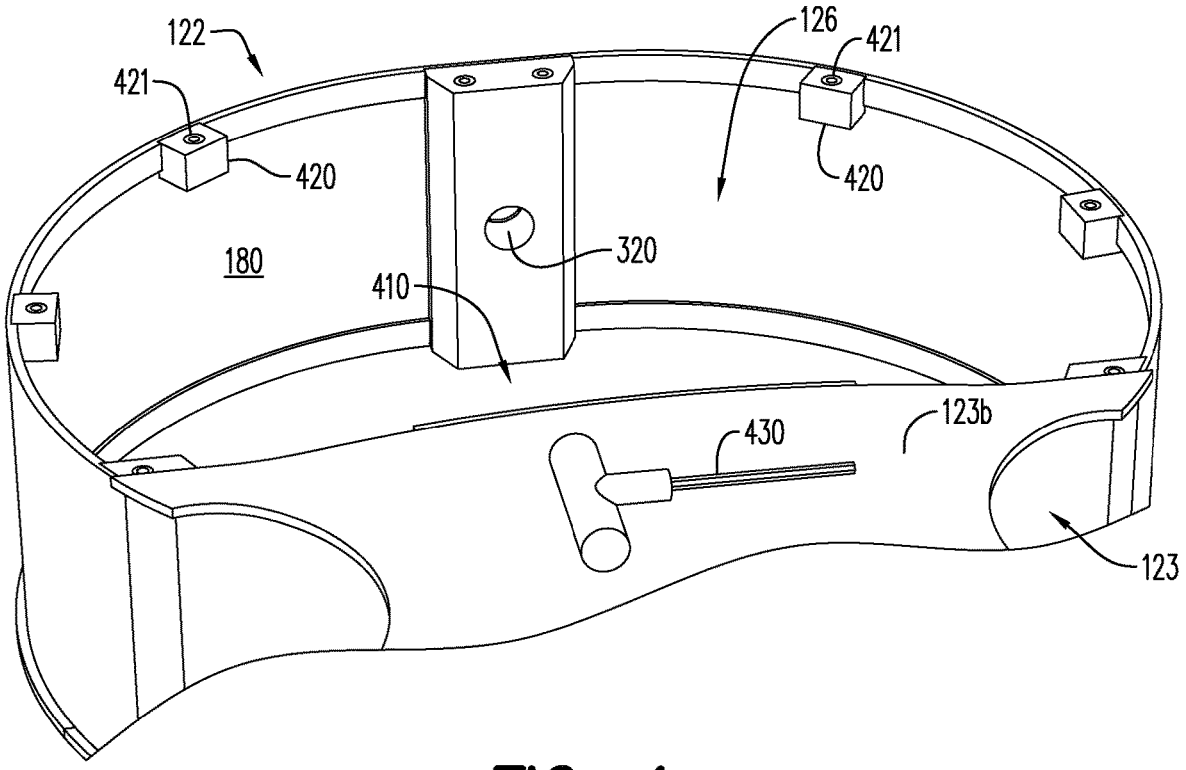
FIG. 4 shows a partial perspective view of the LB portion with the rear face panel of the LB portion removed.

Moving now to FIG. 4, the LB portion 122 is shown in a state of partial disassembly. The rear face panel 122*b* of the LB portion 122 has been removed. In the exemplary embodiment(s) shown in FIGS. 3 and 4, the removable fasteners 310, 310*a* are screw/washer fasteners. Some of the screw/washer fasteners 310 are threadingly received by fastener receiving cavities 421 on the connecting blocks 420. The removable central fasteners 310*a* (e.g., screw/washer fasteners) are threadingly received by the respective central fastener receiving cavities 611 on the lower lip 610*b* of the central rear face panel 123*b*. The fastener receiving cavities 421 on the connecting blocks 420 may include, for example and without limitation, complimentary threaded portions/inserts (not numbered) that threadingly receive the removable fasteners 310. The removable fasteners 310 are removed by rotating the removable fasteners 310 in a disengaging direction d2 (see FIG. 9) until the removable fasteners 310 fully retreat from the fastener receiving cavities 421. In the same or other embodiments, and wherever removable fasteners 310, 310*a* are referenced in this disclosure, the removable fasteners 310, 310*a* may include, for example and without limitation, snaps, clips, straps, magnets, friction-fit assemblies, or other known fasteners and their complementary components.

Continuing now with reference to the exemplary embodiment shown in FIG. 4, the connecting blocks 420 are connected to the sidewall 180 of the LB portion 122 within the hollow cavity 126 of the LB portion 122, and extend away from the sidewall 180 within the hollow cavity 126 of the LB portion 122. In the same or other embodiments, the connecting blocks 420 may be configured in any fashion consistent with this disclosure. Each non-central aperture 510 in the rear face panel 122*b* of the LB portion 122 is substantially aligned with a corresponding fastener receiving cavity 421 within the hollow cavity 126 of the LB portion 122, in an assembled state. The central apertures 510*a* (see FIG. 6B) in the rear face panel 122*b* of the LB portion 122 are substantially aligned with the central fastener receiving cavities 611 on the lower lip 610*b* of the central rear face panel 123*b*, in an assembled state. The respective removable fasteners 310 that removably secure the rear face panel 122*b* of the LB portion 122 to the LB portion 122 are removed from, and inserted into, the fastener receiving cavities 421 using, for instance, a screw tool 430 (see FIG. 4). The screw tool 430 fits frictionally into a portion of the removable fastener 310 and is operative to rotate the removable fastener in an engaging direction d1 (see FIG. 9) and a disengaging direction d2.

Figure 5:
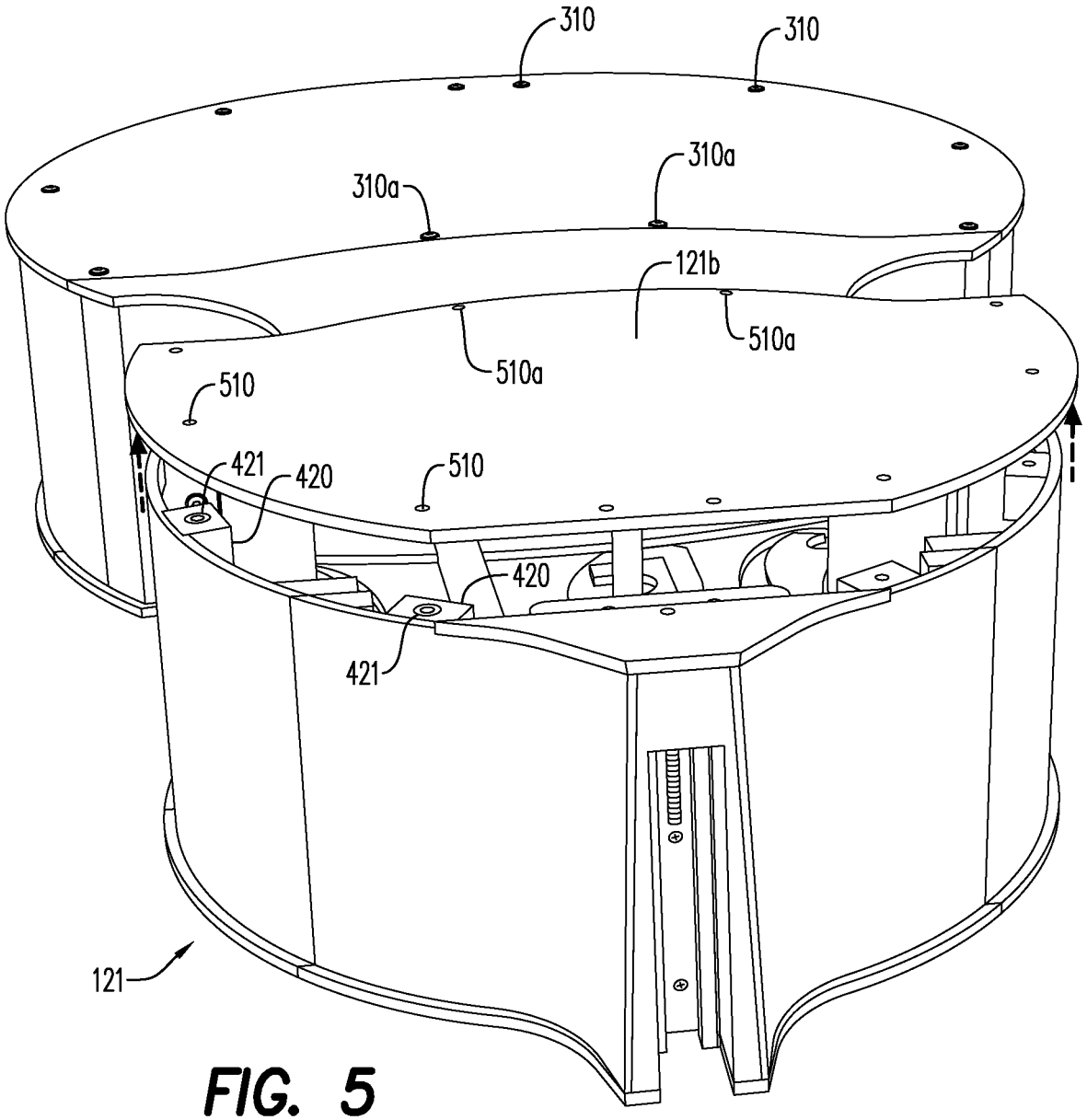
FIG. 5 shows a perspective view of the rear face panel of the UB portion in a state of disassembly from the UB portion.

With reference now to FIG. 5, the UB portion 121 is shown in a state of partial disassembly. In the exemplary embodiment shown in FIG. 5, the rear face panel 121*b* of the UB portion 121 is being removed from the UB portion 121. As previously discussed with respect to FIGS. 3 and 4, the rear face panel 121*b* of the UB portion 121 includes apertures 510 which are substantially aligned, in an assembled state, with fastener receiving cavities 421 on fastener blocks 420 which are attached to the sidewall 180 within the hollow cavity 125 of the UB portion 121. The removable fasteners 310 are removed from the rear face panel 121*b* of the UB portion, for example using the screw tool 430, thereby releasing the rear face panel 121*b* of the UB portion 121 from the UB portion 121. The rear face panel 121*b* of the UB portion 121 further includes the central apertures 510*a* that are substantially aligned with the central fastener receiving cavities 611 on the upper lip 610*a* of the central rear face panel 123*b*, in an assembled state.

Figure 6A:
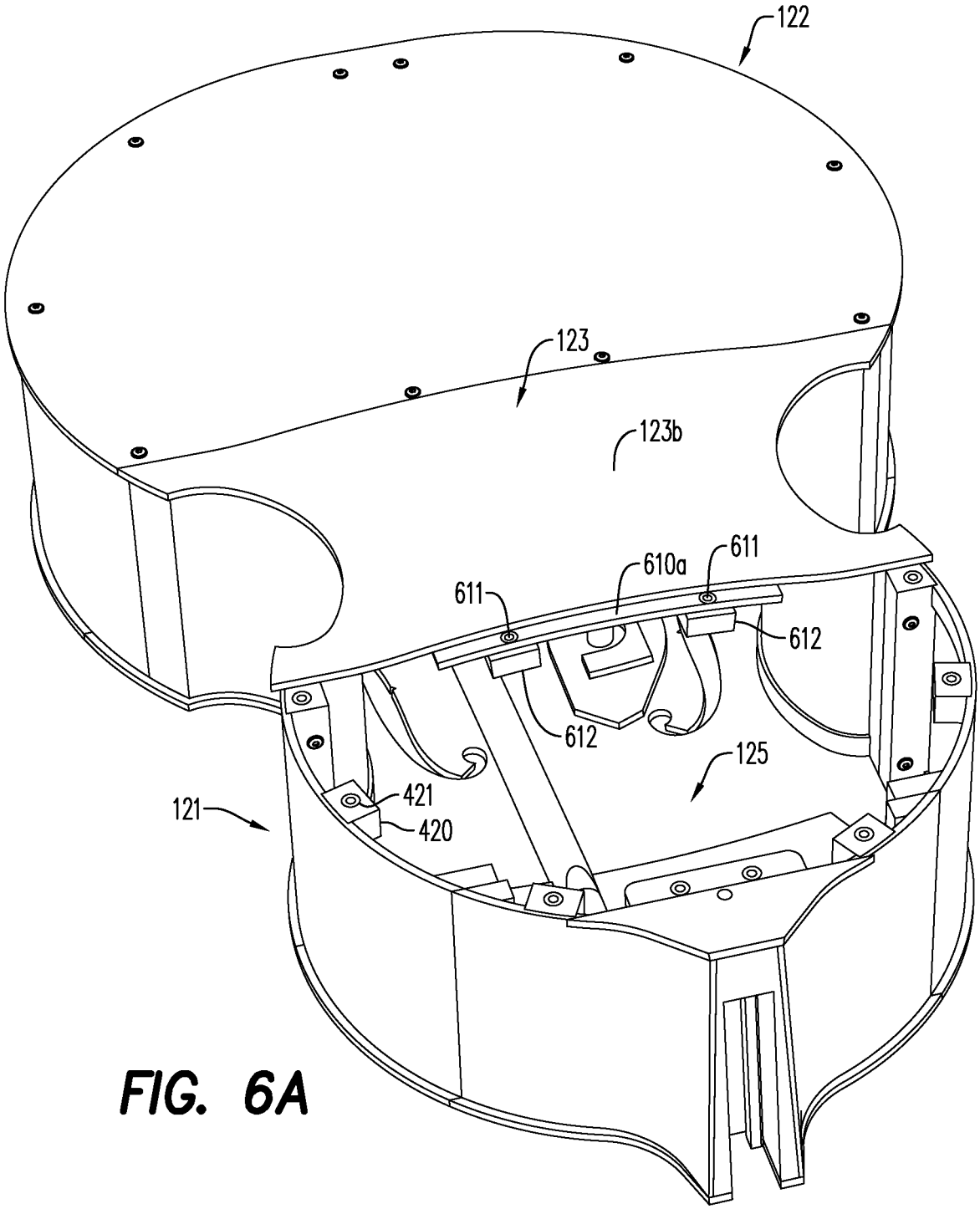
FIG. 6A shows a partial perspective view of the UB portion with the rear face panel of the UB portion removed.

FIG. 6A shows an exemplary packable upright bass 100 with the rear face panel 121*b* of the UB portion 121 removed. As shown in FIG. 6A, the hollow cavity 125 of the UB portion 121 includes fastener blocks 420 having fastener receiving cavities 421, as previously discussed. FIG. 6A further shows the upper lip 610*a* of the central rear face panel 123*b* for connecting the central rear face panel 123*b* to the rear face panel 121*b* of the UB portion 121. The upper lip 610*a* is connected to the central rear face panel 123*b*, and extends away from the central rear face panel 123*b* in a direction toward the rear face panel 121*b* of the UB portion 121. The upper lip 610*a* includes one or more central fastener receiving cavities 611 for receiving the removable central fasteners 310*a* that removably secure the rear face panel 121*b* of the UB portion 121 to the central rear face panel 123*b*. The removable central fasteners 310*a* extend between the rear face panel 121*b* of the UB portion 121 and the central fastener receiving cavities 611 on the upper lip 610*b*, through the central apertures 510*a*. The removable central fasteners 310*a* may be screw/washer fasteners, as previously discussed, and may be respectively inserted into, and removed from, the central fastener receiving cavities 611 by rotating the central fasteners 310*a* with the screw tool 430. The exemplary upper lip 610*a* shown in FIG. 6A also includes support blocks 612 for supporting/extending the central fastener receiving cavities 611 on the upper lip 610*a*.

Figure 6B:
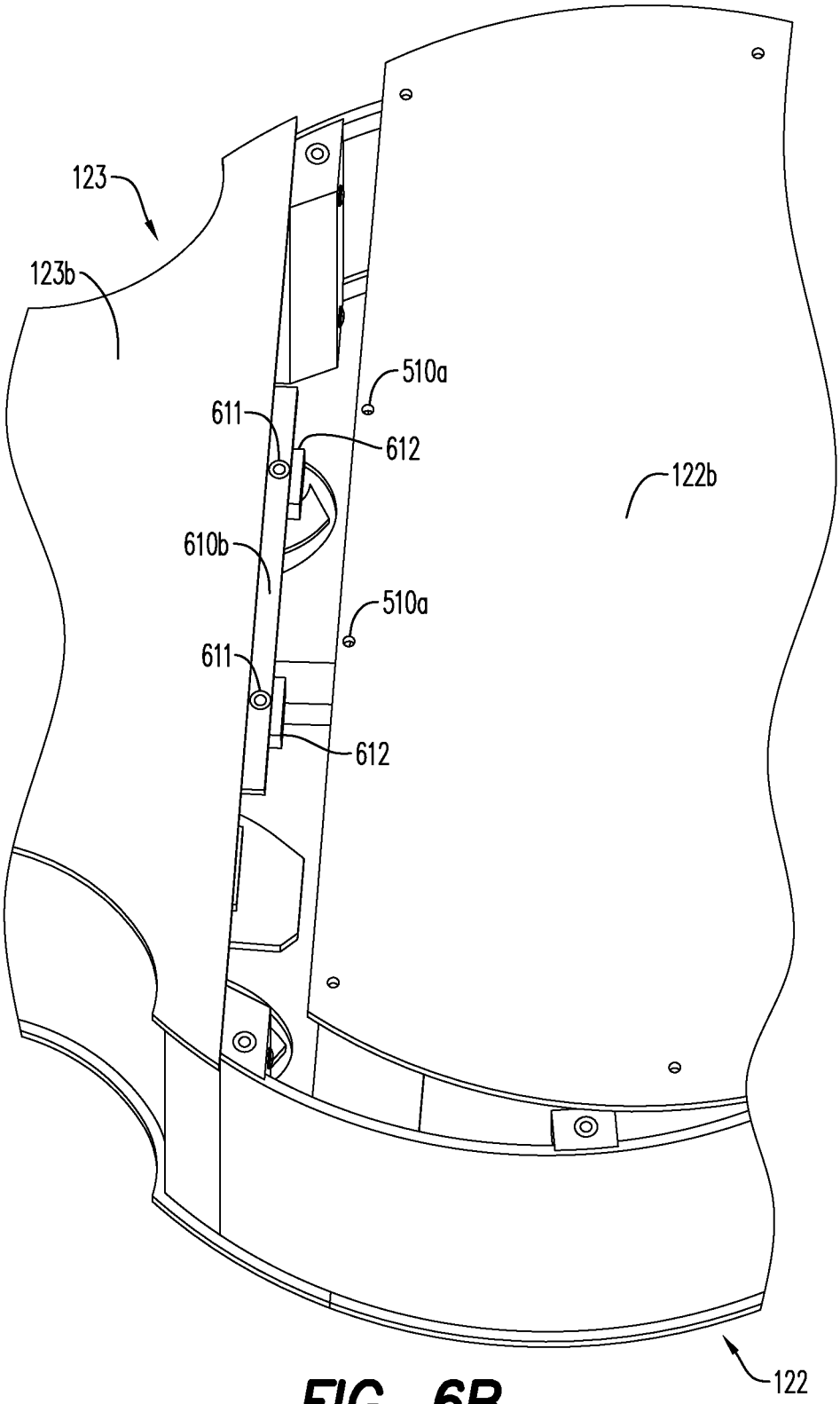
FIG. 6B shows a top view of the central rear face panel of the central body portion in a state of disassembly from the LB portion.

Turning now to FIG. 6B, the lower lip 610*b* of the central rear face panel 123*b* is shown. The lower lip 610*b* is connected to the central rear face panel 123*b*, and extends away from the central rear face panel 123*b* in a direction towards the rear face panel 122*b* of the LB portion 122. Central apertures 510*a* in the rear face panel 122*b* of the LB portion 122 are substantially aligned with central fastener receiving cavities 611 on the lower lip 610*b*, in an assembled state. Central fasteners 310*a* extend between the rear face panel 122*b* of the LB portion 122 and the central fastener receiving cavities 611 on the lower lip 610*b*, through central apertures 510*a*. The removable central fasteners 310*a* may be screw/washer fasteners, as previously discussed, and may be respectively inserted into, and removed from, the central fastener receiving cavities 611 by rotating the central fasteners 310*a* with the screw tool 430. The exemplary lower lip 610*b* shown in FIG. 6B also includes support blocks 612 for supporting/extending the central fastener receiving cavities 611 on the lower lip 610*b*.

Figure 7A:
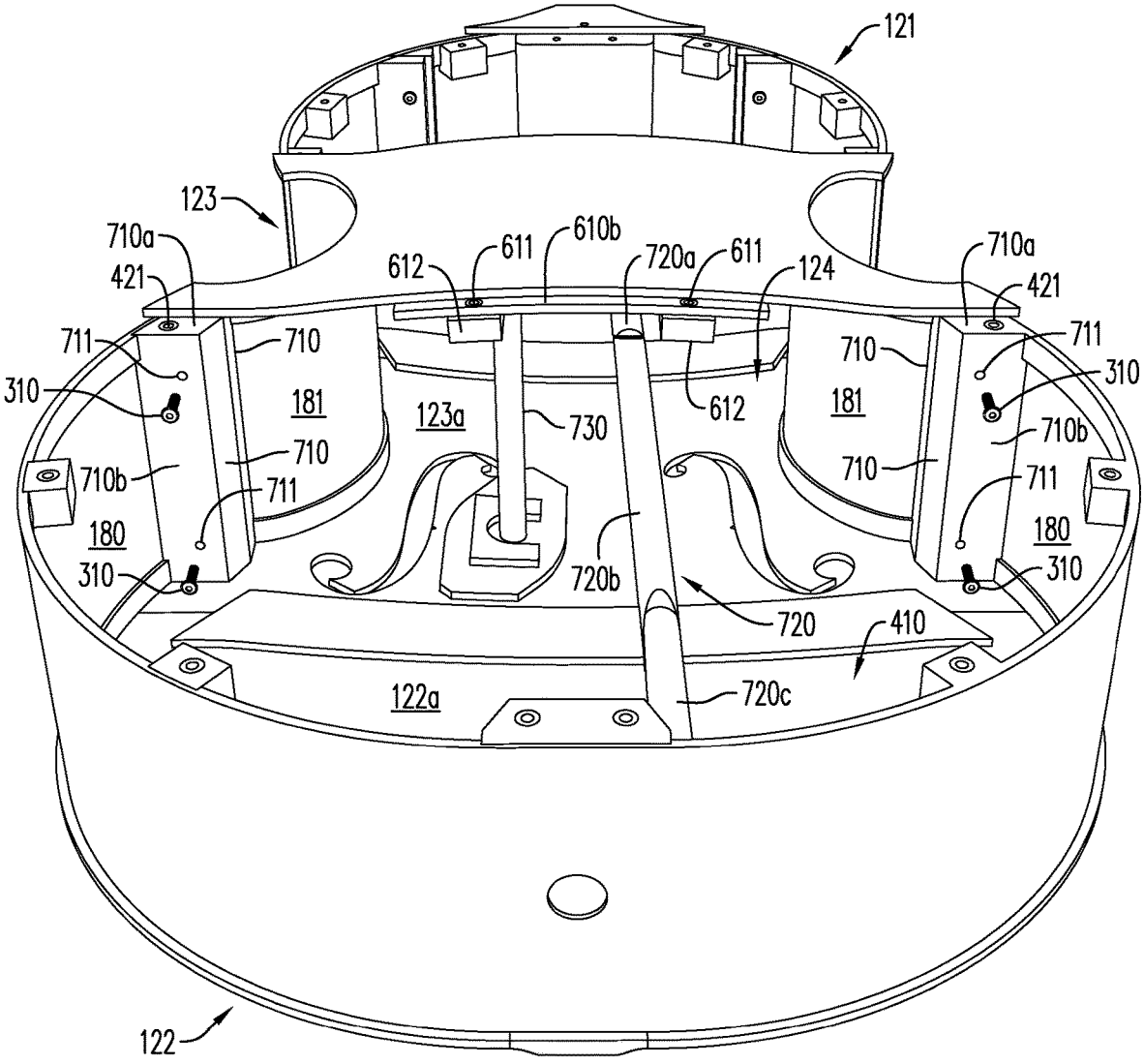
FIG. 7A is a partial perspective view of a hollow interior of the body portion, in a direction from the LB portion to the UB portion.
Figure 7B:
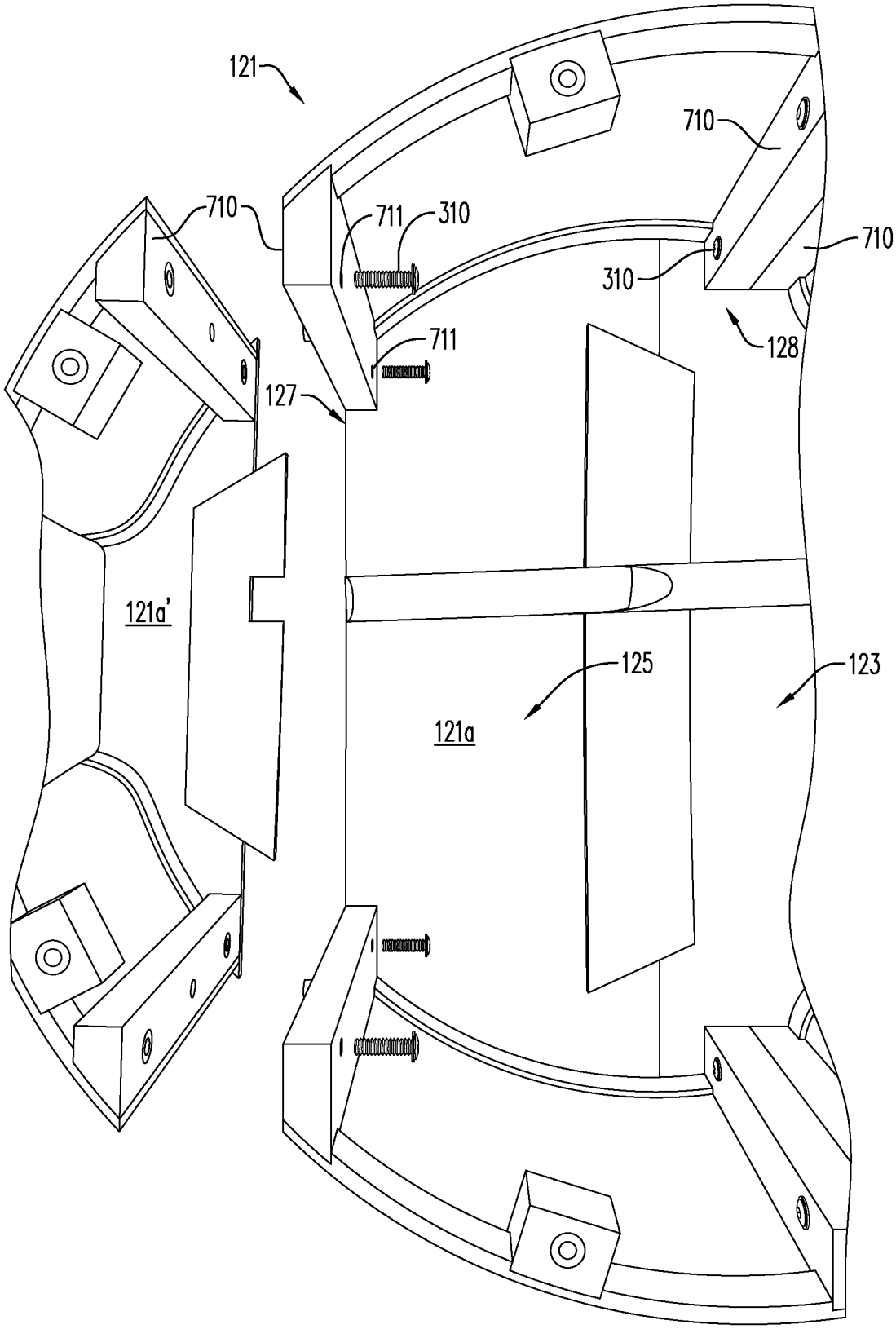
FIG. 7B shows a partial top view of a first UB portion and a second UB portion in a state of disassembly from each other, in an exemplary embodiment of a packable upright bass having two UB portions.
Figure 8:
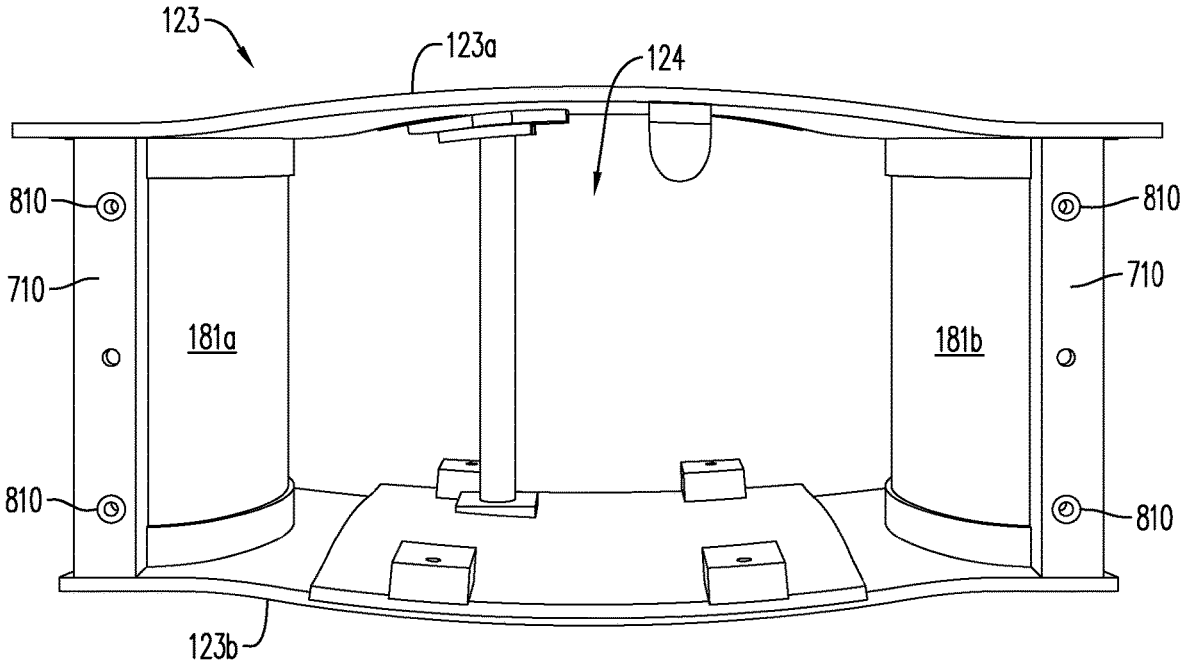
FIG. 8 is a perspective view of an exemplary, integral central body portion.

FIG. 7A shows a perspective view through the hollow interior 410 of the body portion 120, in a direction from the LB portion 122 to the UB portion 121. The exemplary configuration shown in FIG. 7A includes a plurality of joining blocks 710 for connecting in part the respective rear face panels 121*b*, 122*b* of the UB portion 121 and LB portion 122 to the corresponding UB portion 121 and LB portion 122, and for connecting each of the UB portion 121 and LB portion 122 to the central body portion 123 (representative joining blocks 710 of the LB portion 122 are shown in FIG. 7A, while joining blocks 710 of the UB portion 121 are shown in FIG. 7B and joining blocks 710 of the central body portion 123 are shown in FIG. 8, each discussed below). Each joining block 710 in the exemplary embodiment shown in FIG. 7A is oriented to extend substantially vertically along a sidewall 180 of the LB portion 122. Each joining block 710 of the LB portion 122 may include one or more fastener receiving cavities 421 on a top of the joining block 710*a*, for receiving a removable fastener 310 through an aperture 510 in the rear face panel 122*b*, in a direction from the rear face panel 122*b* to the front face panel 122*a*. The respective joining blocks 710 of the LB portion 122 further include one or more apertures 711 through a side portion 710*b* of the joining block 710, wherein each aperture 711 is substantially aligned, in an assembled state, with a joining block fastener receiving cavity 810 (see FIG. 8) on a joining block 710 of the central body portion 123. Further, each joining block 710 of the LB portion 122 substantially abuts a joining block 710 of the central body portion 123, in an assembled state. One or more removable fasteners 310 extend between each joining block 710 of the LB portion 122 and the corresponding joining block fastener receiving cavity 810, through the apertures 711 in the joining blocks 710 of the LB portion 122. In this fashion, the LB portion 122 is in part removably secured to the central body portion 123. As previously discussed, the removable fasteners 310 may be screw/washer fasteners, and may be respectively inserted into, and removed from, the joining block fastener receiving cavities 810 by rotating the removable fasteners 310 with the screw tool 430.

FIG. 7A also shows certain internal components of the exemplary packable upright bass 100. For example, FIG. 7A shows a sound post 730 positioned within the central body portion 123 that extends between a portion of the central front face panel 123*a* and the central rear face panel 123*b*, within the hollow cavity 124 of the central body portion 123. The sound post 730 is not typically fixedly attached, but is held by the pressure of the strings and bridge. The sound post 730 counteracts forces that are created by the bridge 210 against the body portion 120 when the strings 140 are tensioned across the bridge 210. FIG. 7A also shows a segmented bass bar 720 that extends across at least a portion of each of the LB portion 122, central body portion 123, and UB portion 121. The segmented bass bar 720 is divided into a top segment 720*a*, a central segment 720*b*, and a bottom segment 720*c*. The top segment 720*a*, the central segment 720*b*, and the bottom segment 720*c* are respectively attached, within the hollow interior 410 of the body portion 120, to the front face panel 121*a* of the UB portion 121, the central front face panel 123*b*, and the front face panel 122*a* of the LB portion 122. In the exemplary embodiment shown in FIG. 7A, the top segment 720*a*, the central segment 720*b*, and the bottom segment 720*c* of the bass bar 720 are separable from each other, so as to remain affixed to their corresponding body segments 121, 123, 122 when the body portion 120 is disassembled according to the exemplary embodiments. At least a portion of the top segment 720*a* and the central segment 720*b* overlap, and at least a portion of the bottom segment 720*c* and the central segment 720*b* overlap.

Moving now to FIG. 7B, a perspective view of the hollow cavity 125 in the UB portion 121 is shown. In the exemplary embodiment shown in FIG. 7B, the UB portion 121 includes a first front face panel 121*a* and a second front face panel 121*a*'. The first front face panel 121*a* is positioned between the second front face panel 121*a*' and the central body portion 123. Accordingly, the first front face panel 121*a* includes joining blocks 710 on each of an upper side 127 and a lower side 128 of the first front face panel 121*a*. The joining blocks 710 on the lower side 128 of the first front face panel 121*a* abut corresponding joining blocks 710 on the central body portion 123, in an assembled state. Further, the joining blocks 710 on the bottom side 128 of the first front face panel 121*a* include apertures 711 that are substantially aligned, in an assembled state, with corresponding joining block fastener receiving cavities 810 on the joining blocks 710 of the central body portion 123, as previously described and shown in FIG. 8. The joining blocks 710 on the upper side 127 of the first front face panel 121*a* abut corresponding joining blocks 710 on the second front face panel 121*a*', in an assembled state. Further, the joining blocks on the upper side 127 of the first front face panel 121*a* include apertures 711 that are substantially aligned, in an assembled state, with corresponding joining block fastener receiving cavities (not numbered) on the joining blocks of the second front face panel 121*a*'. One or more removable fasteners 310 extend between each joining block 710 of the first front face panel 121*a* and the corresponding joining block fastener receiving cavities (e.g., 810) of the central body portion 123 and second front face panel 121*a*', through the apertures 711 in the joining blocks 710 of the first front face panel 121*a*. In this fashion, the first front face panel 121*a* and the second front face panel 121*a*' are in part removably secured to each other, and the UB portion 121 is in part removably secured to the central body portion 123. As previously discussed, the removable fasteners 310 may be screw/washer fasteners, and may be respectively inserted into, and removed from, the joining block fastener receiving cavities (e.g., 810) by rotating the removable fasteners 310 with the screw tool 430.

With reference now to FIG. 8, an isolated view of the exemplary central body portion 123 is shown. In the exemplary embodiment, the central body portion 123 is an integral unit including, among other things, the central front face panel 123*a*, the central rear face panel 123*b*, and the central sidewall 181 (shown in FIG. 8 as including the left central sidewall 181*a* and the right central sidewall 181*b*, as previously indicated). The central front face panel 123*a*, the central rear face panel 123*b*, and the central sidewall 181 define the hollow cavity 124 of the central body portion 123. The particular view shown in FIG. 8 is in a direction from the UB portion 121 to the LB portion 122. The central body portion 123 includes joining blocks 710 substantially as described with respect to the UB portion 121 and LB portion 122. The joining blocks 710 of the central body portion 123 extend substantially vertically along the central sidewall 181, within the hollow cavity 124 of the central body portion 123. The central body portion 123 includes at least one joining block 710 that abuts a joining block 710 of the UB portion 121, and at least one joining block 710 that abuts a joining block 710 of the LB portion 122. Further, the joining blocks 710 of the central body portion 123 include joining block fastener receiving cavities 810 for receiving the removable fasteners 310 that extend between the respective joining blocks 710 of the UB portion 121 and the LB portion 122 and the joining block fastener receiving cavities 810, through the apertures 711 in the respective joining blocks 710 of the UB portion 121 and the LB portion 122. In this fashion, each of the UB portion 121 and LB portion 122 may be in part removably secured to the central body portion 123.

Figure 9:
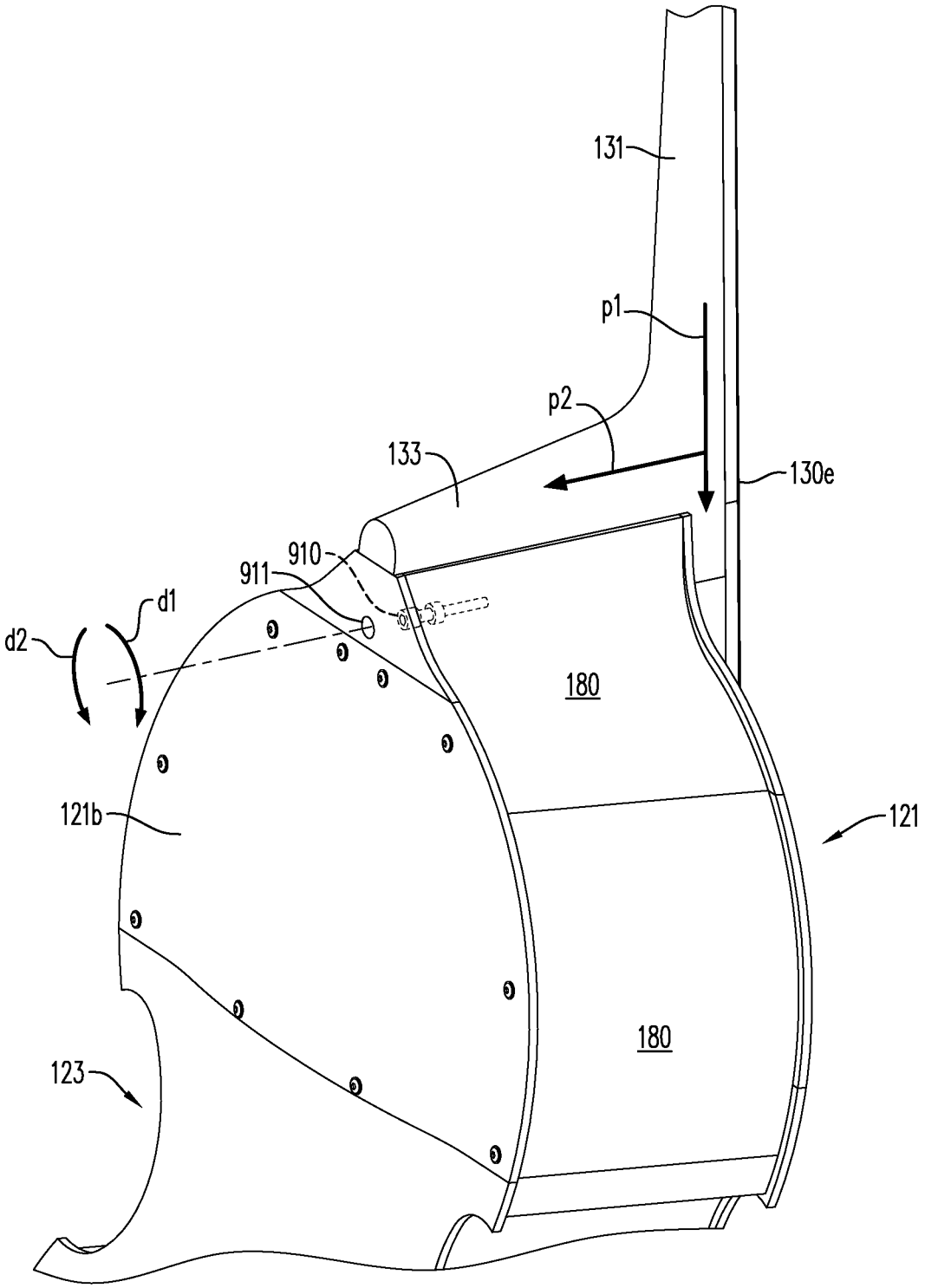
FIG. 9 shows a partial perspective view of the rear face panel of the UB portion, including a set screw and set screw aperture for a neck connecting portion.
Figure 10:
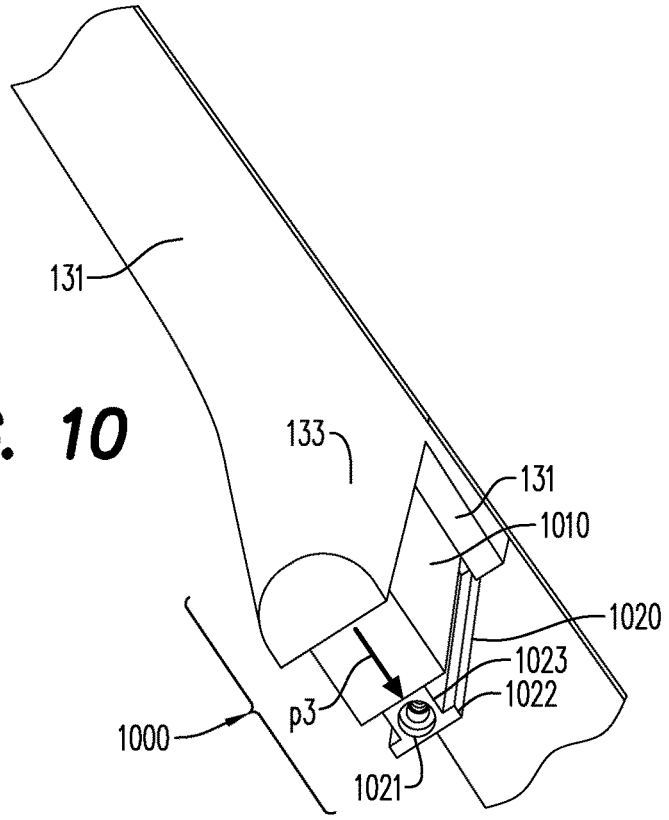
FIG. 10 shows a perspective view of the neck connecting portion of the neck portion.
Figure 11A:
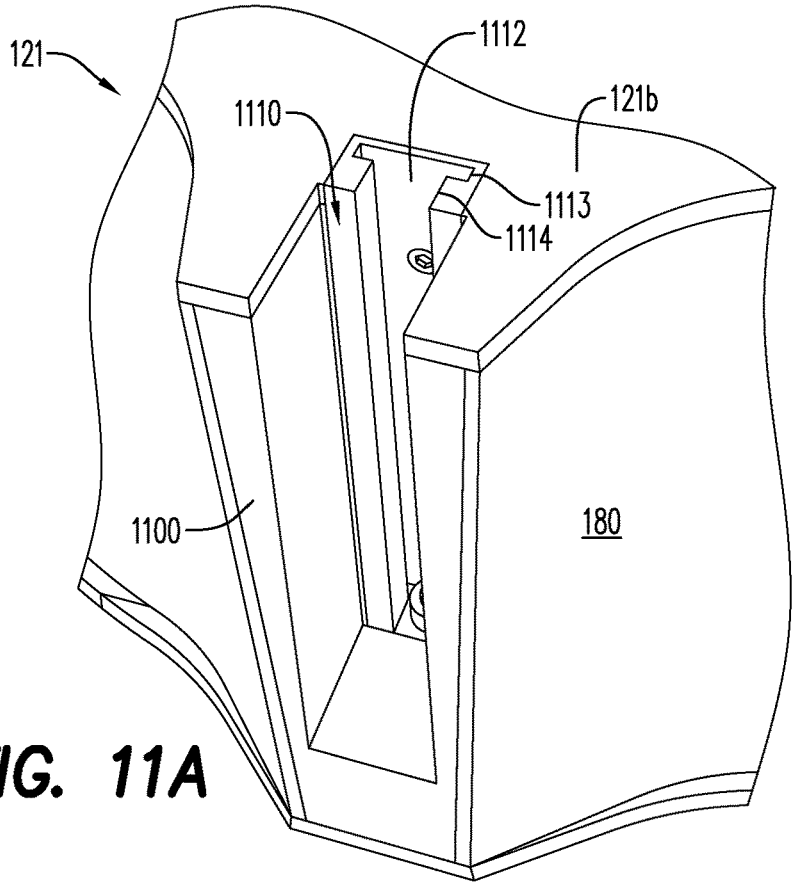
FIG. 11A is a first perspective view of a connecting block on the body portion corresponding to the neck connecting portion.
Figure 11B:
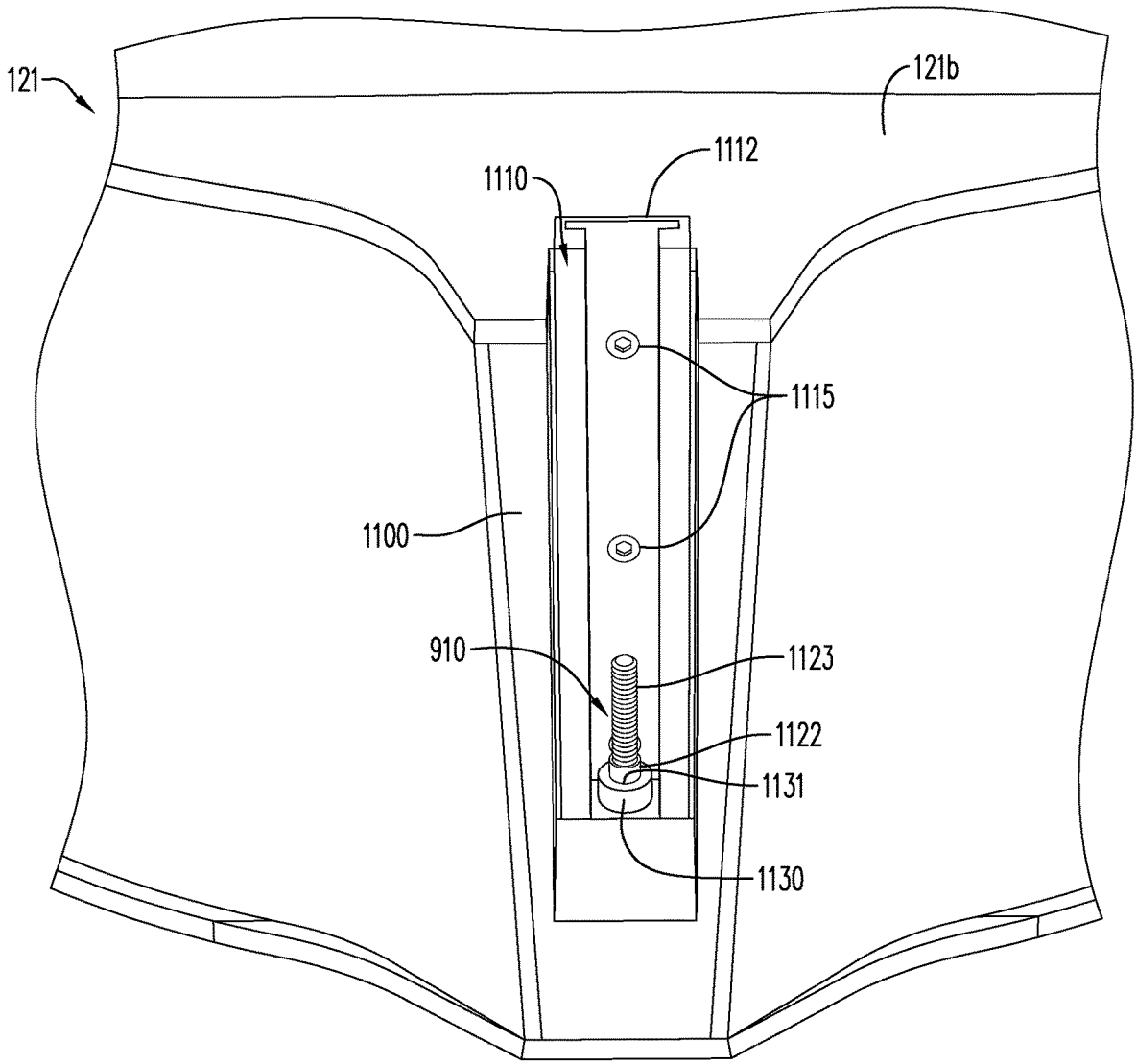
FIG. 11B is a second perspective view of the connecting block.
Figure 11C:
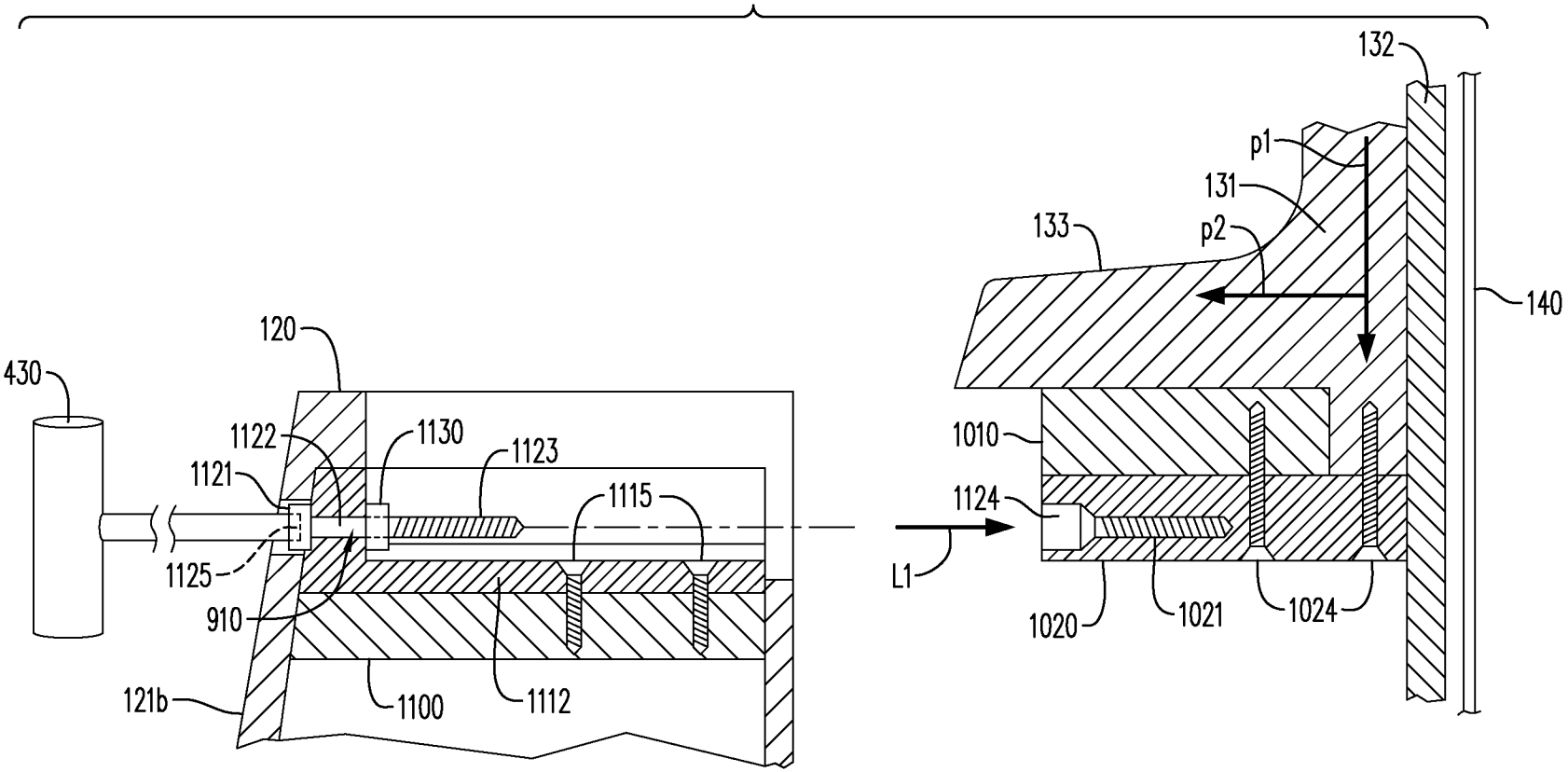
FIG. 11C is a schematic showing the neck connecting portion and connecting block.

Continuing now with reference to FIGS. 9-11C, an exemplary neck connecting portion 1000 is shown. The neck connecting portion 1000 and a connecting block 1100 on the body portion 120 together provide an adjustable, releasable connection between the neck portion 130 and the body portion 120. As shown in FIGS. 9, 10, and 11C, the neck connecting portion 1000 includes, among other things, a heel 133, a tongue 1010, and a T-rail 1020. The heel 133 extends away from the neck portion 130 in a direction p2 that is substantially perpendicular to a direction p1 from the first end 130*a* of the neck portion 130 to the second end 130*b* of the neck portion 130. In the exemplary disclosed embodiments, the heel 133 is integral with, or rigidly secured to, the neck body 131. The tongue 1010 is affixed to the heel 133, and the tongue 1010 extends away from the heel 133 in a direction p3 from the heel 133 towards the body portion 120. The T-rail 1020 is affixed to the tongue 1010, and the T-rail 1020 extends away from the tongue 1010 further in the direction p3 from the heel 133 towards the body portion 120. The tongue 1010 may be affixed to the heel 133 and/or neck body 131 by, for example and without limitation, adhesives (glues, epoxies, resins, etc.), mechanical fasteners (screws, nails, clips, etc.), magnets, and/or other known affixing techniques consistent with this disclosure. In the exemplary disclosed embodiments, the tongue 1010 is affixed to the heel 133 by an adhesive. In other embodiments, the tongue 1010 and the heel 133 may be integral. Further, in the exemplary disclosed embodiments, the T-rail 1020 is affixed to the tongue 1010 and/or neck body 131 by T-rail screws 1024 (see FIG. 11C). In the same or other embodiments, the T-rail 1020 may be integral with the tongue 1010, or affixed to the tongue 1010 by, for example and without limitation, adhesives (glues, epoxies, resins, etc.), different mechanical fasteners (nails, clips, etc.), and/or other known affixing techniques consistent with this disclosure. An exemplary T-rail 1020 may be formed from a lightweight metal, such as aluminum. The exemplary T-rail 1020 also includes a threaded aperture 1021 that extends into the T-rail 1020 in a longitudinal direction L1, for connecting to the connecting block 1100 of the body portion 120 as described below.

The connecting block 1100 (see FIGS. 11A-11C) of the body portion 120 is formed on the UB portion 121. The connecting block 1100 includes, among other things, a hollow cavity 1110 that extends into the connecting block 1100, wherein the hollow cavity 1110 includes a T-joint 1112 within the connecting block 1100. The T-joint 1112 is shaped complimentarily to the T-rail 1020, so as to slidingly receive the T-rail 1020 within the T-joint 1112, in an assembled state. For example, the T-rail 1020 includes a wide portion 1022 and a narrow portion 1023 and the T-joint 1112 includes a wide portion 1113 and a narrow portion 1114, such that the wide portion 1022 of the T-rail 1020 is slidingly received by the wide portion 1113 of the T-joint 1112, and the narrow portion of the T-rail 1020 is slidingly received by the narrow portion 1114 of the T-joint 1112.

The T-joint 1112 may be formed integrally with the cavity 1110 within the connecting block 1100, wherein the cavity 1110 defines the T-joint 1112, or the T-joint 1112 may be a separate component that is affixed within the cavity 1110. In the exemplary disclosed embodiments, the T-joint 1112 is in part a separate component that is affixed within a complimentary portion of the cavity 1110 to the connecting block 1100/body portion 120 by T-joint screws 1115.

The T-joint 1112 further includes a set screw 910 (see FIGS. 9, 11B) and a clamp bushing 1130 for mating with the threaded aperture 1021 of the T-rail 1020, thereby adjustably and removably securing the neck portion 130 to the body portion 120 when the neck connecting portion 1000 is received within the cavity 1110 of the connecting block 1000. The set screw 910 includes a screw head 1121 and a screw shaft 1122, and the screw shaft 1122 extends away from the screw head 1121. The screw shaft 1122 includes a threaded portion 1123 that is complimentary to the threaded aperture 1021 of the T-rail 1020 and operative to threadingly engage the threaded aperture 1021. In an assembled state, the threaded portion 1123 of the screw shaft 1122 is threadingly received within the threaded aperture 1021 of the T-rail 1020. Rotating the set screw 910 in the first, engaging direction d1 causes the screw shaft 1122 to advance into the threaded aperture 1021 of the T-rail 1020 and thereby tighten the connection between the neck portion 130 and the body portion 120. On the other hand, rotating the set screw in the second, disengaging direction d2 causes the screw shaft 1122 to retreat from the threaded aperture 1021 of the T-rail 1020 and thereby loosen the connection between the neck portion 130 and the body portion 120. Continued rotation of the set screw 910 in the disengaging direction d2 will eventually cause the set screw 910 to disengage from the threaded aperture 1021 of the T-rail 1020, and thereby disconnect the neck connecting portion 1000 from the connecting block 1100 on the body portion 120. The exemplary arrangement also allows the neck portion 130 to move respectively away from or towards the strings 140 as the set screw 910 is rotated in the engaging d1 direction and disengaging d2 direction. This movement allows individual musicians to set a preferred height away from the fingerboard 132 for their strings 140. Further, the movement of the neck portion 130 does not change the tension on the strings 140, because the strings 140 are not directly connected to the neck portion 130. In fact, the head portion 110 may be held to the neck portion 130*a* using only the tension created by the strings 140 between the string connectors 160 on the head portion 110 and the tailpiece 150.

The set screw 910 may be any type of screw or fastener consistent with this disclosure. In an aspect of the exemplary disclosed embodiments, all of the removable fasteners 310 used in the packable stringed instrument 100, including the set screw 910 and the removable central fasteners 310*a*, are configured for being engaged/disconnected by a single screw tool 430, thus increasing convenience when assembling/disassembling the instrument. In the exemplary embodiment(s) shown in FIGS. 11A-11C, the set screw 910 extends between the rear face panel 121*b* of the UB portion 121 and the T-joint 1112, through a set screw aperture 911 in the rear face panel 121*b* of the UB portion 121, and through a hollow interior 1131 of the clamp bushing 1130 within the T-joint 1112. The hollow interior 1131 of the clamp bushing 1130 is substantially aligned within the T-joint 1112 with the set screw aperture 911. The clamp bushing 1130 and/or other features of the set screw 910, such as an enlarged portion within the T-joint 1112, may keep the set screw 910 from falling out of the hollow cavity 1110 in the connecting block. The screw head 1121 of the set screw 910 is accessible through the set screw aperture 911, and the screw head 1121 is configured to receive the screw tool 430, e.g., within a cavity 1125 on the screw head 1121. The screw tool 430 is operative to rotate the set screw 910 in the same fashion that has been described with respect to other removable fasteners 310, 310*a*.

In the exemplary embodiments shown in FIGS. 9 and 11A-11C, the connecting block 1100 is formed integrally in the UB portion 121. In other embodiments, the connecting block 1100 may be a separate component that is rigidly affixed or removably secured to the UB portion 121. Various arrangements may be possible, within the spirit and scope of this disclosure, provided that the arrangements allow the instrument 100 to have an acceptable sound quality or other properties that may be important to different musicians.

Figure 12B:
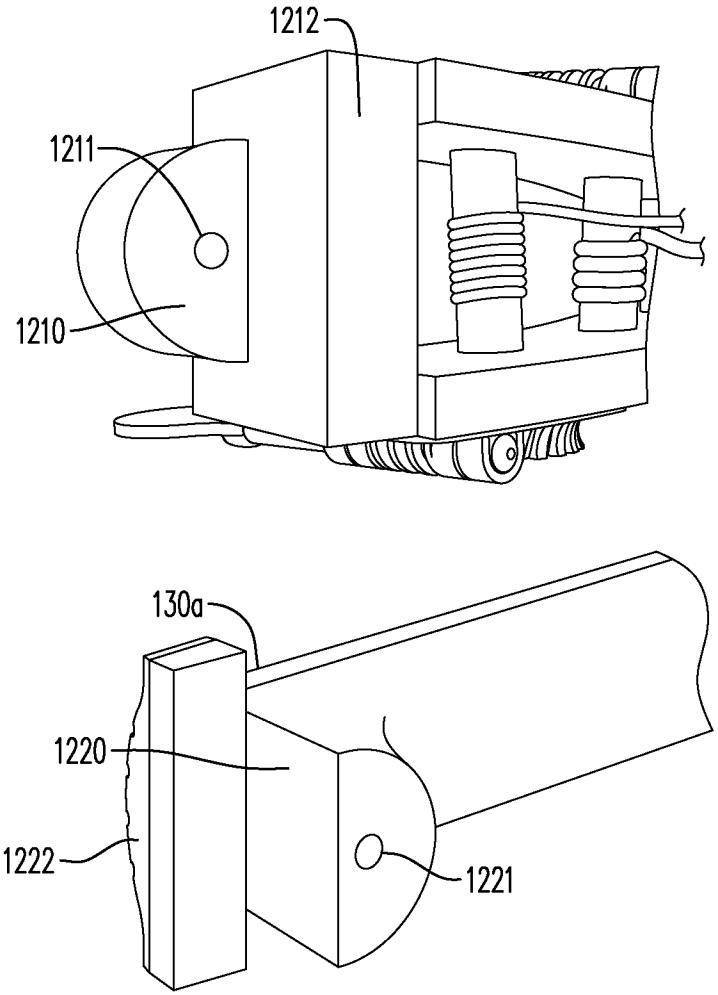
FIG. 12B is a second perspective view of the head portion and the neck portion in a disassembled state.
Figure 12A:
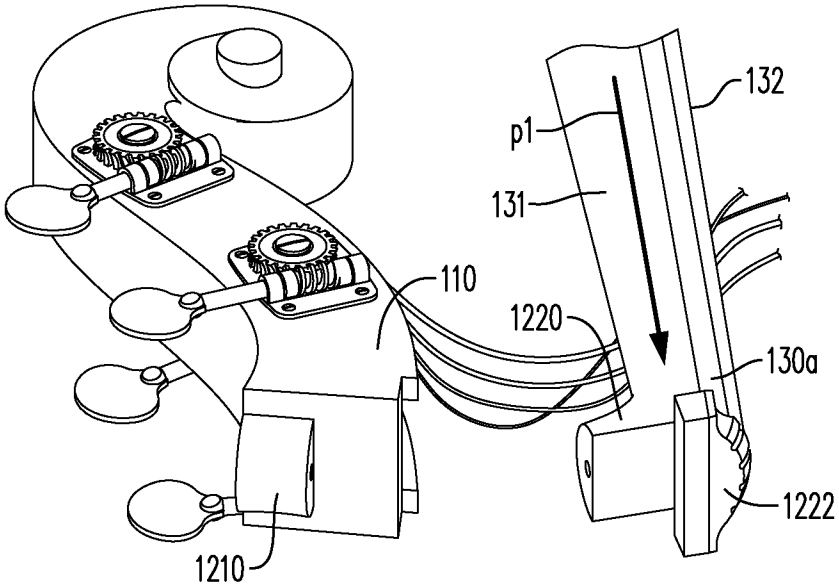
FIG. 12A is a first perspective view of the head portion and the neck portion in a disassembled state.

With reference now to FIGS. 12A and 12B, an exemplary arrangement of the head portion 110 and neck portion 130 is shown. The head portion 110 includes a fastener tab 1210 and a fastener tab block 1212. The fastener tab 1210 extends away from the fastener tab block 1212 in a direction from the head portion 110 towards the neck portion 130. Further, the fastener tab 1210 includes a hollow center passage 1211 that is substantially aligned with a fastener receiving cavity 1221 in a ridge 1220 of the neck portion 130, in an assembled state. The ridge 1220 is integral with the neck body 131 in the exemplary embodiment, and the ridge 1220 extends away from the neck body 131 in the direction p2 that is substantially perpendicular to the direction p1 from the first end 130*a* of the neck portion 130 to the second end 130*b* of the neck portion 130. The ridge block 1222 extends away from the ridge 1220 in a direction from the neck portion 130 to the head portion 110. These and other components of the head portion 110 and the neck portion 130, respectively, may be integrally formed, rigidly connected, removably secured, or provided in any configuration within the spirit and scope of this disclosure.

In an assembled state, the ridge 1220 and the ridge block 1222, respectively and together, are complimentarily shaped to the fastener tab 1210 and the fastener tab block 1212. For example, the ridge 1220 abuts at least a portion of the fastener tab 1210 and the fastener tab block 1212, and the ridge block 1222 abuts at least a portion of the fastener tab block 1212. As previously indicated, the hollow center passage 1211 of the fastener tab 1210 is substantially aligned with the fastener receiving cavity 1221 of the ridge 1220. A removable fastener 310 extends between the fastener tab 1210 and the fastener receiving cavity 1221 of the ridge 1220, through the hollow center passage 1211 of the fastener tab 1210.

With reference now to FIGS. 13A-18B, an exemplary method for disassembling the exemplary disclosed packable upright bass 100 embodiments is described. The steps need not be performed in the same order as presented herein.

The method may begin by releasing a portion of the string coils on the tuning pegs 160, to loosen the strings 140. Loosening the strings 140 releases the tension created by the strings 140 between the head portion 110 and the tailpiece 150. Once the tension of the strings 140 is sufficiently released, the bridge 210 may be removed from the body portion 120. In the exemplary disclosed embodiments of a packable upright bass 100, the bridge 210 is physically separable from the body portion 120. In an assembled state, the bridge 210 is held in place by tension from the strings 140 that cross the bridge 210.

The tailpiece 150 also is physically separable from the body portion 120 when the string 140 tension is released. In the exemplary embodiment shown in FIG. 13A, the tailpiece 150 is removably secured to the body portion 120 by the string retaining saddle strap 151 that loops around the stand 190 and pulls the tailpiece 150 down towards the body portion 120 when the string 140 tension is applied. The stand 190 itself is also removably inserted into the body portion 120, through the stand aperture 320. Once the strings 140 are sufficiently loosened, the stand 190 may be pulled out of the stand aperture 320 and removed from the body portion 120, thereby releasing the string retaining saddle strap 151.

Figure 13B:
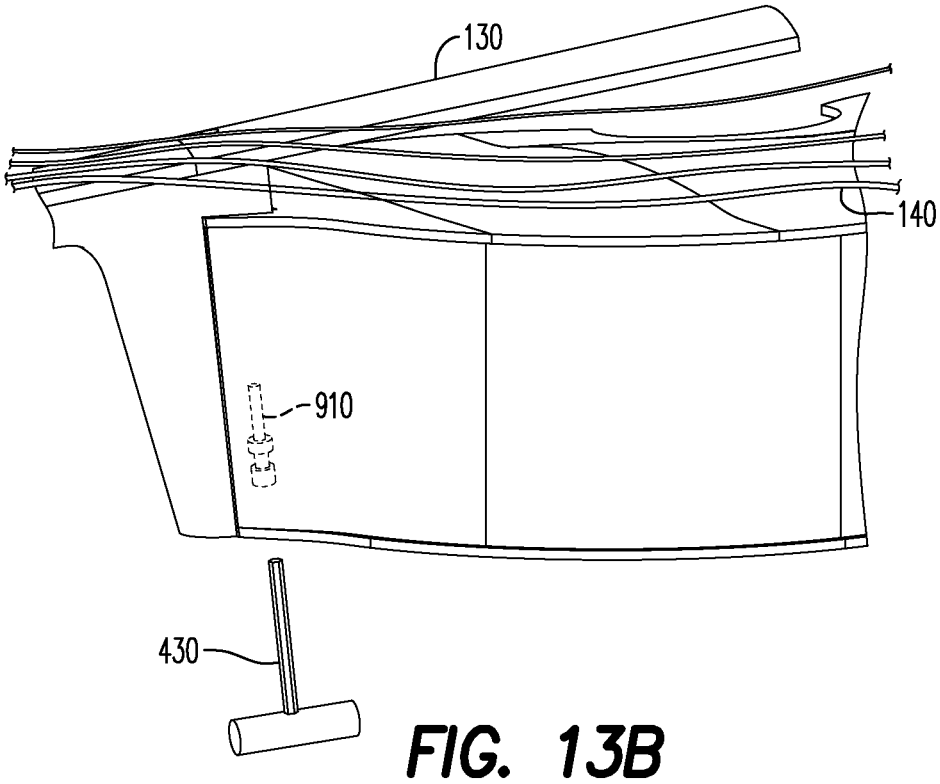
FIG. 13B shows the neck portion being removed from the body portion as part of the exemplary method.
Figure 14:
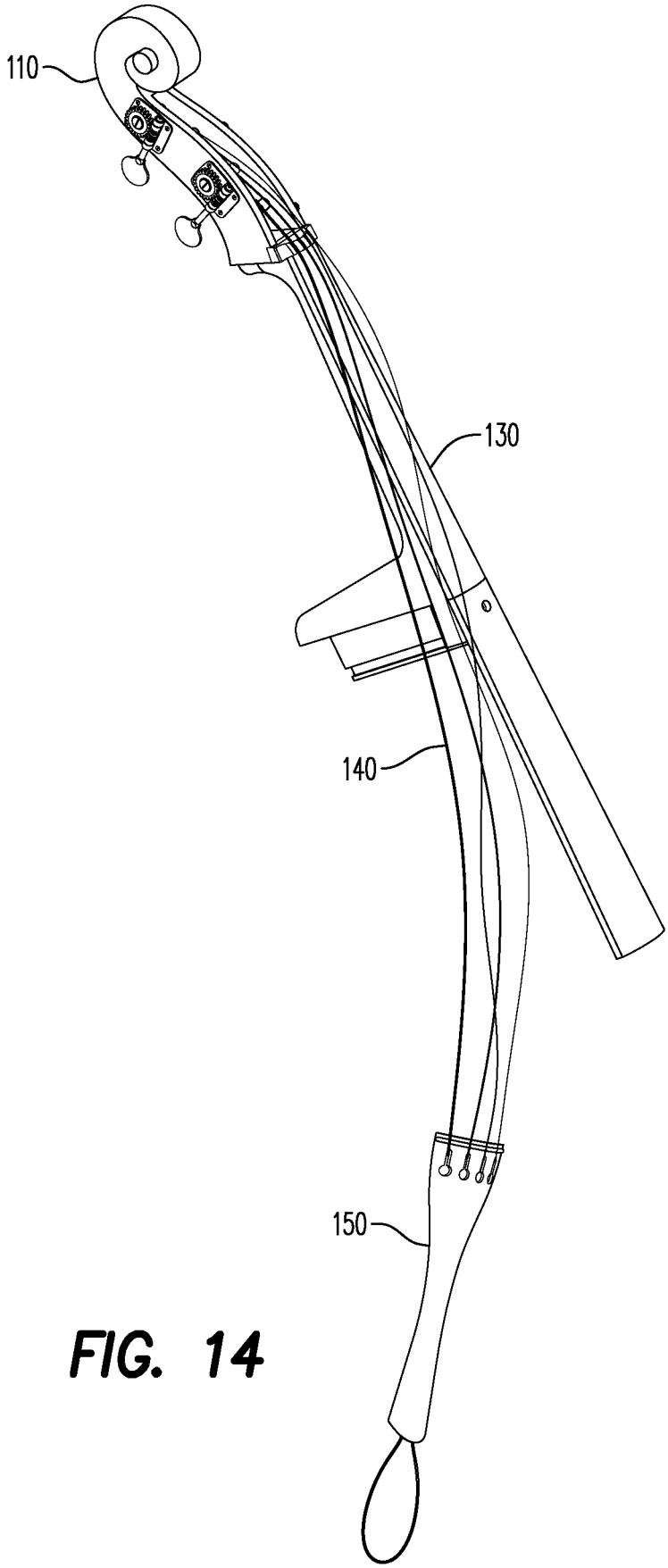
FIG. 14 shows the head portion, the neck portion, strings, and a tailpiece of the packable stringed instrument removed from the body portion.

With reference now to FIG. 13B and the exemplary method, the set screw 910 may be removed from the threaded aperture 1021 in the T-rail 1020 by rotating the set screw 910 in the disengaging direction d2 with the screw tool 430. When the set screw 910 is disengaged from the threaded aperture 1021, the neck portion 130 may be removed from the connecting block 1100 of the body portion 120, for example by sliding the neck connecting portion 1000 out of the connecting block 1100. When the tailpiece 150 and the neck portion 130 have been removed from the body portion 120, the tailpiece 150, the strings 140, the neck portion 130, and the head portion 110 may be removed as one connected piece, as shown in FIG. 14. The head portion 110 may then be removed from the neck portion 130 by removing the removable fastener 310 that extends between the fastener tab 1210 of the head portion 110 and the fastener receiving cavity 1221 of the ridge 1220, as previously discussed with respect to FIGS. 12A and 12B.

Figure 15:
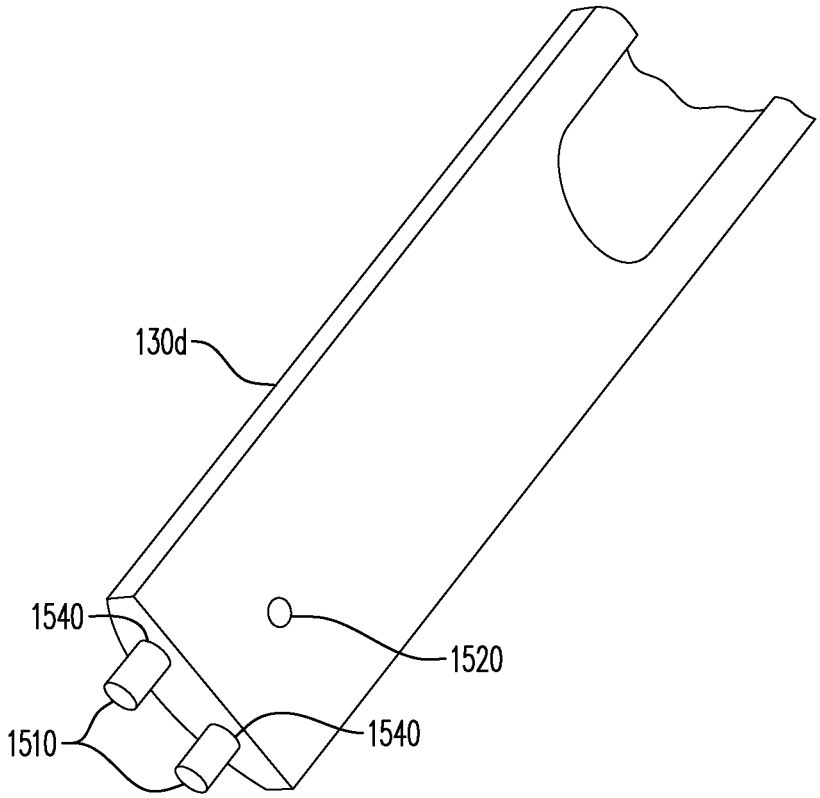
FIG. 15 shows an upper section of the neck portion and a lower section of the neck portion in a disassembled state.
Figure 15:
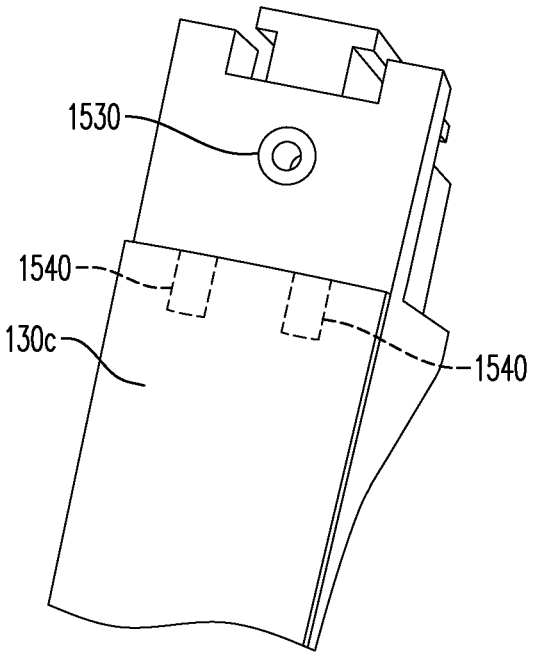

With reference now to FIG. 15, after the head portion 110, the neck portion 130, the tailpiece 150, and the strings 140 have been removed from the body portion 120, the neck portion 130 may be further broken down into an upper neck portion segment 130*c* and a lower neck portion segment 130*d*. In an assembled state, the upper neck portion segment 130*c* and the lower neck portion segment 130*d* are aligned by dowels 1510 that are inserted respectively into dowel receiving cavities 1540 on the upper neck portion segment 130*c* and the lower neck portion segment 130*d*. In other embodiments, the dowels 1510 may be replaced by, for example and without limitation, carbon fiber rods or other assemblies that are configured to align the upper neck portion segment 130*c* and the lower neck portion segment 130*d* in an assembled state. The upper neck portion 130*c* and the lower neck portion 130*d* are removably secured to each other, in an assembled state, by a removable fastener 310 (not shown in FIG. 15) that extends between the fingerboard 132 of at least one of the upper neck portion 130*c* and the lower neck portion 130*d*, to a neck fastener receiving cavity 1530 on the other portion 130*c*, 130*d*, through neck fastener aperture 1520. The neck fastener aperture 1520 is positioned on an area of the fingerboard 132 that is not aligned with a string 140 in an assembled state, and therefore does not interfere with the playability of the instrument. The separated neck portion 130, the head portion 110, and the tailpiece 150 may be stacked or otherwise consolidated for storage, travel, etc.

Figure 16:
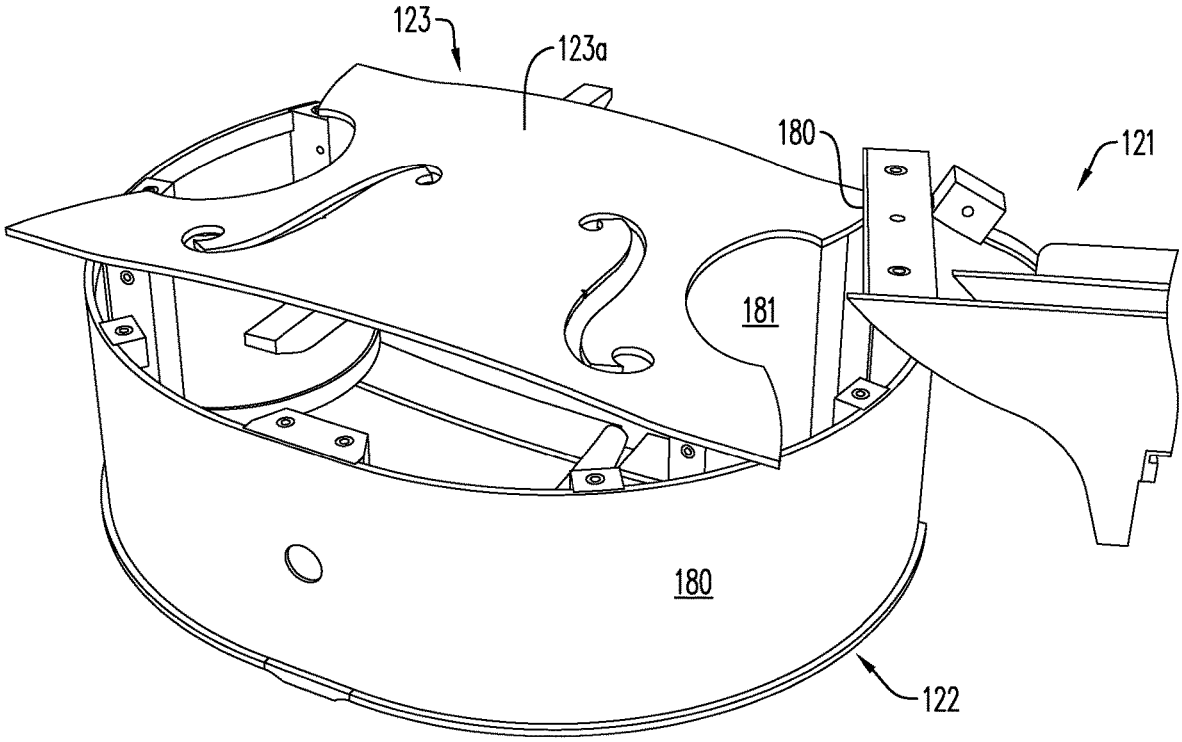
FIG. 16 shows stacking removed components of an exemplary packable stringed instrument, according to an exemplary method of disassembling and packing the instrument.

Moving on to FIG. 16, and with continuing reference to FIGS. 2-8, the rear face panel 121*b* of the UB portion 121 and the rear face panel 122*b* of the LB portion 122 may respectively be removed from UB portion 121 and the LB portion 122 by removing the corresponding removable fasteners 310 with the screw tool 430. Each of the rear face panels 121*b*, 122*b* may be removed from the central body portion 123 by removing the removable central fasteners 310*a* with the screw tool 430. Once each of the rear face panels 121*b*, 122*b* is removed, the removable fasteners 310 that connect the joint blocks 710 within the hollow interior 410 of the body portion 120 may be removed with the screw tool 430. In this fashion, each of the UB portion 121 and LB portion 122 may be removed from the central body portion 123. In embodiments where at least one of the UB portion 121 and LB portion 122 includes two or more front face panels (e.g., 121*a*, 121*a*'), the respective front face panels of the UB portion 121 and/or LB portion 122 may be separated from each other by removing the removable fasteners 310 that connect the joining blocks 710 of the front face portions.

In the exemplary disclosed embodiments, the sidewalls 180 and central sidewall 181 are respectively either integral with, or rigidly connected to, at least a portion of the front face panel(s) 121*a*, 122*a* of the UB portion 121 and the LB portion 122, and the central front face panel 123*a*. Accordingly, when the UB portion 121, LB portion 122, and central body portion 123 are separated from each other, the sidewalls 180, 181 remain connected to their corresponding front face panels 121*a*, 122*a*, 123*a*. The separated UB portion 121, LB portion 122, and central body portion 123 are shown in part in FIG. 16.

Figure 17:
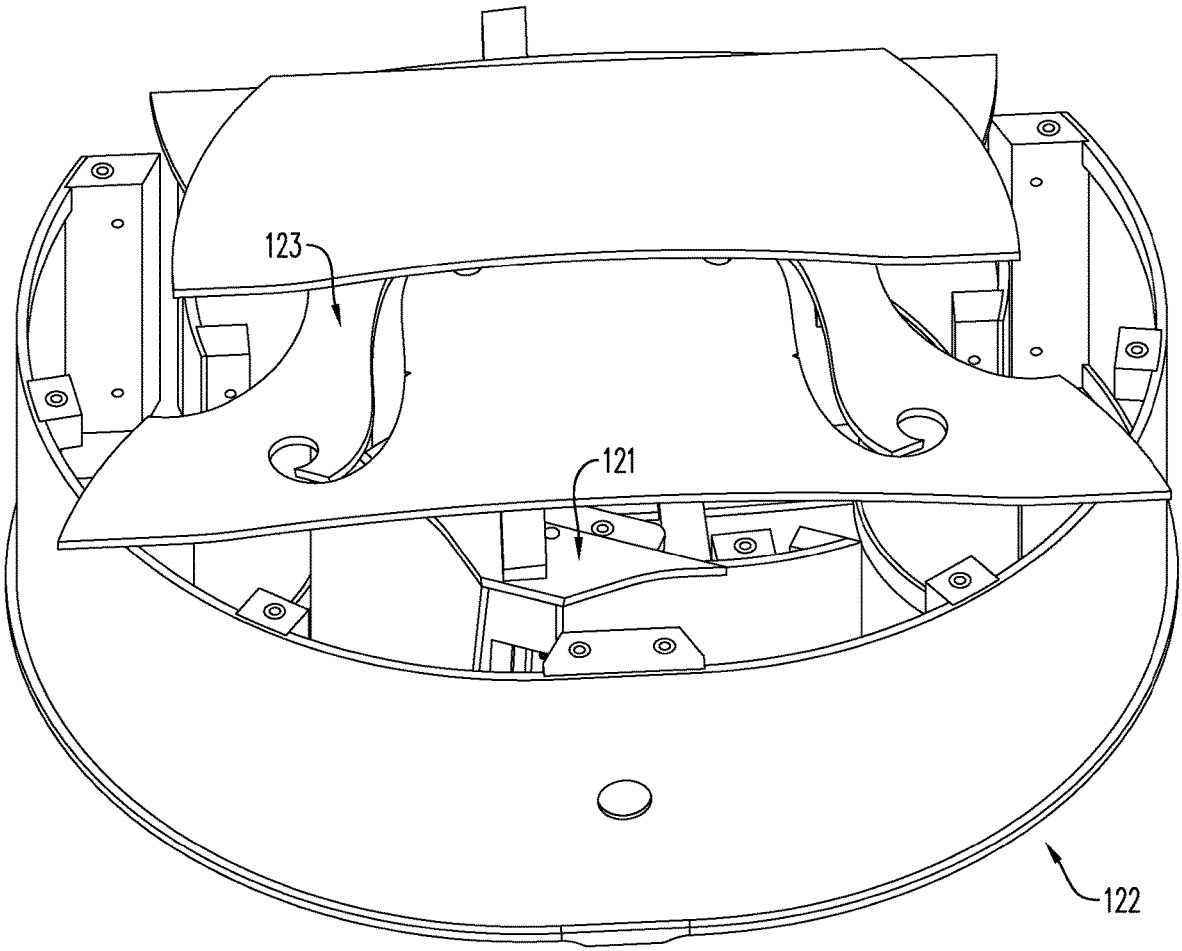
FIG. 17 shows further stacking of removed components of an exemplary packable stringed instrument according to the exemplary method.
Figure 18A:
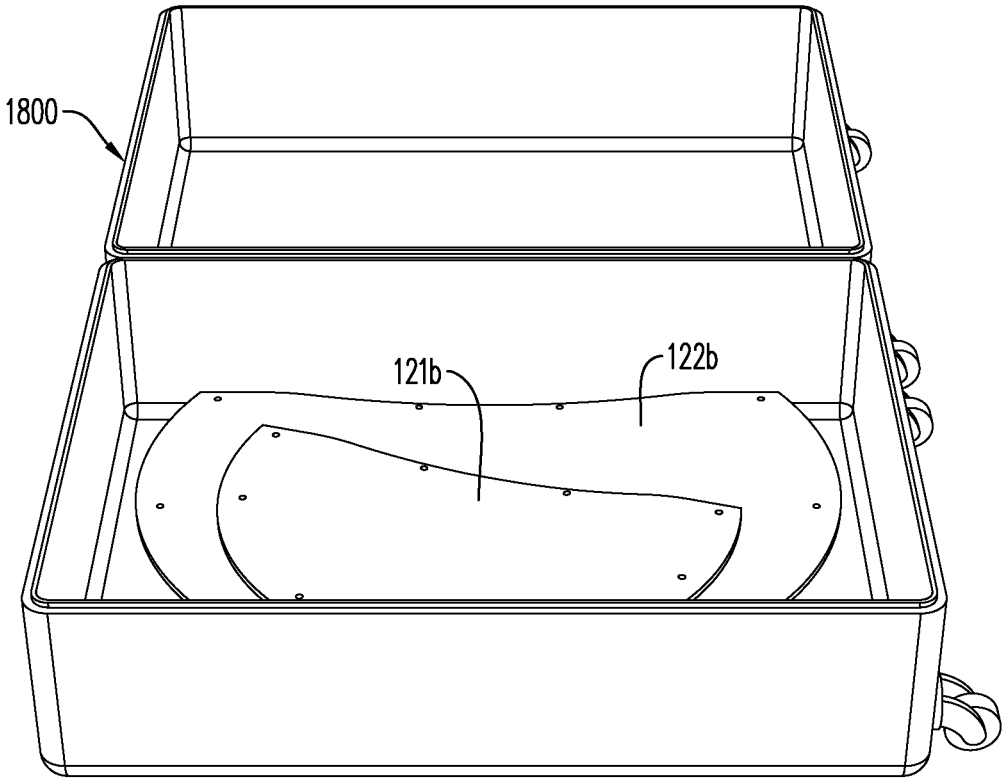
FIG. 18A shows certain removed components of an exemplary packable stringed instrument stacked in a carrying case, according the exemplary method.
Figure 18B:
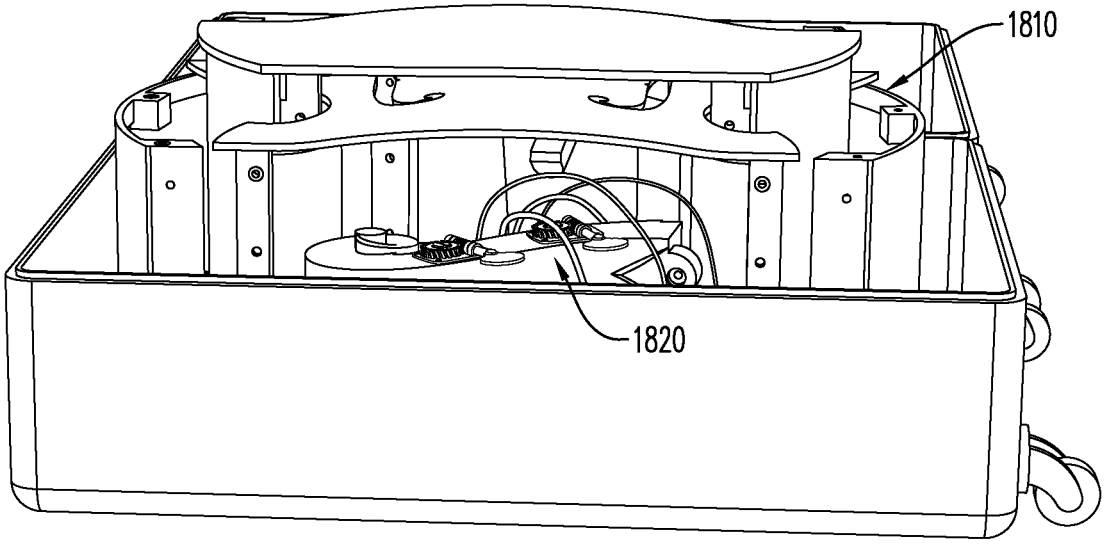
FIG. 18B shows additional removed components of an exemplary packable stringed instrument stacked in the carrying case, according to the exemplary embodiment.
Figure 19:
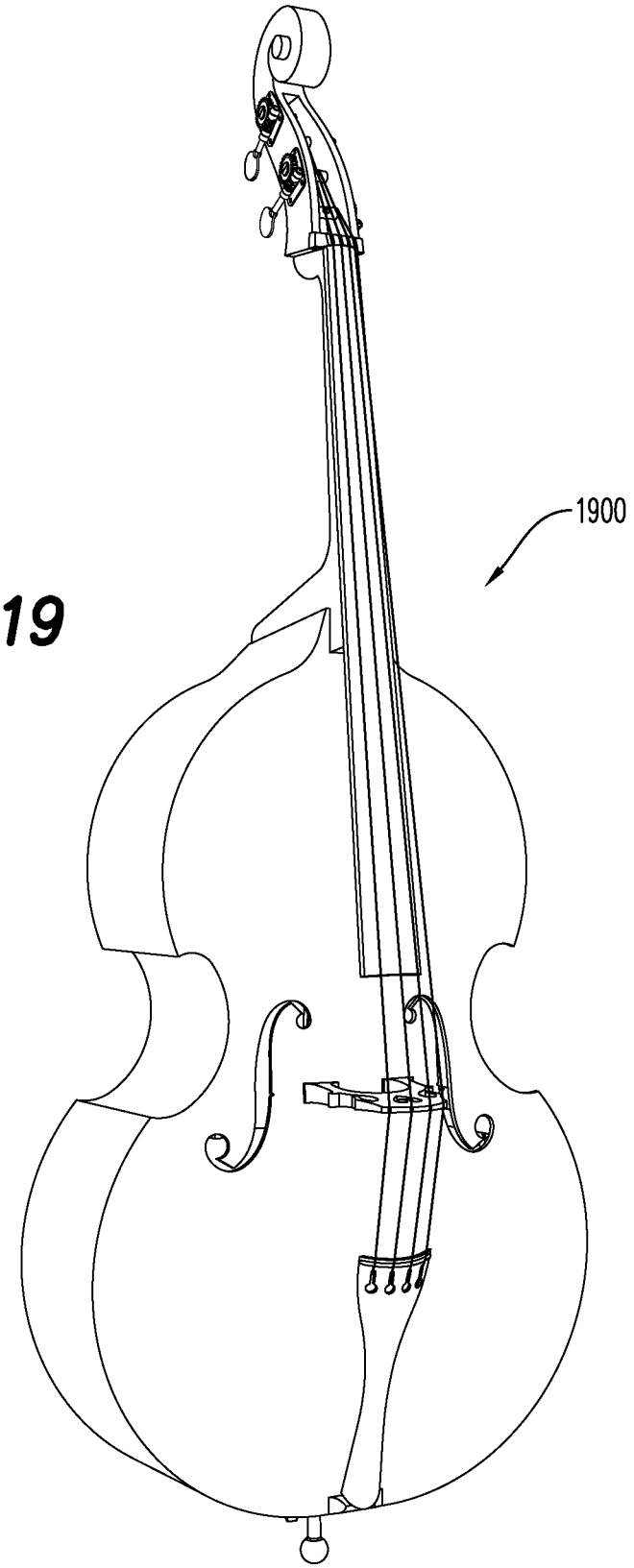
FIG. 19 shows a typical upright (double) bass.
Figure 20:
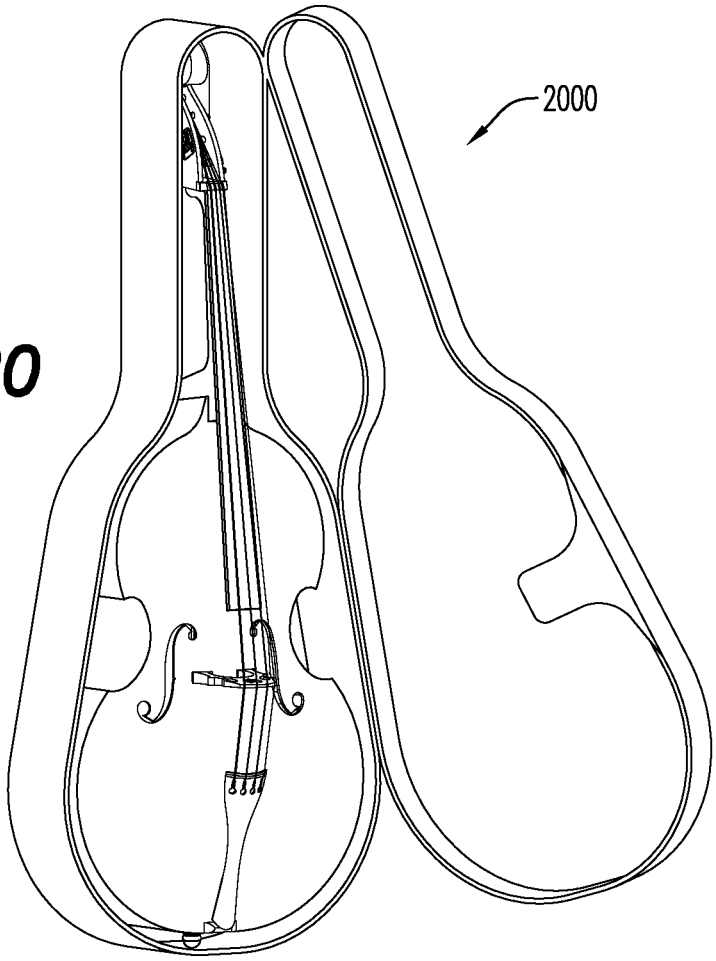
FIG. 20 shows a typical upright (double) bass case.
Figure 21:
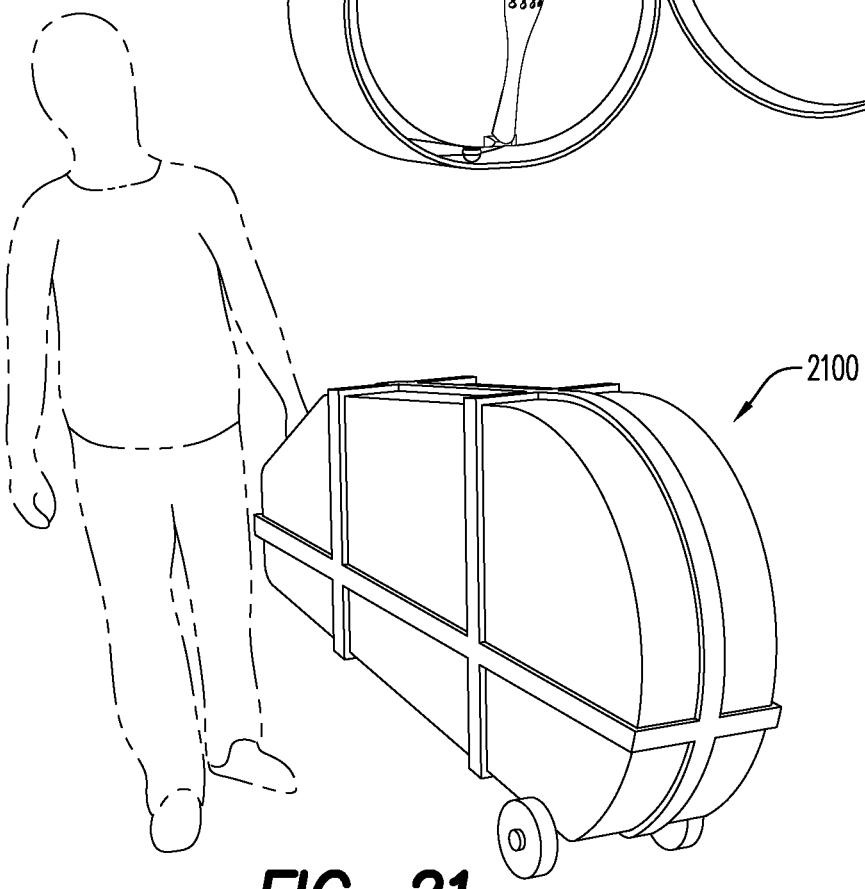
FIG. 21 shows a case for an upright (double) bass with a removable neck.

With reference now to FIG. 17, and continuing reference to FIG. 16, each of the central body portion 123 and UB portion 121 is complimentarily configured, in an exemplary embodiment, to be stacked within the lower body portion 122. In this fashion, the respective segments 121, 122, 123 of the body portion 120 may be consolidated for storage, travel, etc. As shown in FIG. 18A, the separated rear face panels 121*b*, 122*b* may be laid flat within a suitcase 1800, carrying case, etc. (generally, "carrying case 1800"). As shown in FIG. 18B, the stacked body segments 121, 122, 123 may be stacked 1810 on top of the rear face panels 121*b*, 122*b* inside the carrying case 1800. The consolidated 1820 head portion 110, neck portion 130, tailpiece 150, strings 140, and stand 190 may then be placed in the carrying case 1800, e.g., within the hollow cavity 124 of the central body portion 123. In this fashion, each component of the exemplary disclosed packable upright bass 100 may be condensed for storage, travel, etc.

An exemplary method of assembling the packable upright bass 100 substantially includes performing the exemplary disassembly method steps in reverse, and in any order within the scope of this disclosure. For example, the body segments 121, 122, 123 may be unpacked and connected by aligning the central body segment 123 between the UB segment 121 and the LB segment 122, and replacing and tightening the removable fasteners 310 in the joining blocks 710 of the body segments 121, 122, 123. The rear face panels 121*b*, 122*b* of the UB portion 121 and the LB portion 122 may then be reattached to the UB portion 121, LB portion 122, and central body portion 123, by replacing and tightening the removable fasteners 310 through the apertures 510, 510*a* in the rear face panels 121*b*, 122*b*. The upper neck portion segment 130*c* and lower neck portion segment 130*d* may be reattached, e.g., by aligning the segments 130*c*, 130*d* and replacing and tightening the removable fastener 310 through the aperture 1520 in the lower neck portion segment 130*d*. If the head portion 110 is separable or disconnected from the neck portion 130, the head portion 110 and neck portion 130 may be reconnected by, for example, tensioning the strings 140 when the neck portion 130 is reattached to the body portion 120 and/or replacing and tightening any removable fasteners 310 that removably secure the head portion 110 to the neck portion 130, etc. The neck portion 130 may be reconnected to the body portion 120 by sliding the neck connecting portion 1000 into the connecting block 1100, and tightening the set screw 910 within the threaded aperture 1021 of the T-rail 1020.

The exemplary disclosed devices, systems, and methods are applicable to a variety of other stringed instruments, including, but not limited to, bass violins, violas, violins, guitars, cellos, etc.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A packable stringed instrument, comprising:

a head portion;

a body portion, wherein the body portion includes at least one upper body (UB) portion, at least one lower body (LB) portion, and a central body portion, wherein the central body portion is positioned between the UB portion and the LB portion, each of the UB portion and the LB portion is removably connected to the central body portion, the central body portion includes a central front face panel, a central rear face panel, and a central sidewall, together defining a hollow cavity, and the central sidewall extends between at least a portion of the central front face panel and the central rear face panel, the UB portion includes a front face panel and a rear face panel, and the LB portion includes a front face panel and a rear face panel; and, a neck portion, wherein the neck portion includes a first end and a second end, wherein the first end of the neck portion is connected to the head portion, and the second end of the neck portion is connected to the body portion.

2. The packable stringed instrument of claim 1, wherein the central body portion is an integral unit.

3. The packable stringed instrument of claim 1, wherein the rear face panel of the UB portion is removable from the UB portion, and the rear face panel of the LB portion is removable from the LB portion.

4. The packable stringed instrument of claim 3, further comprising a plurality of removable fasteners, wherein the UB portion is removably secured to the central body portion by at least a first removable fastener, the LB portion is removably secured to the central body portion by at least a second removable fastener, the rear face panel of the UB portion is removably secured to the UB portion by at least a third removable fastener, and the rear face panel of the LB portion is removably secured to the LB portion by at least a fourth removable fastener.

5. The packable stringed instrument of claim 4, wherein each of the first removable fastener, the second removable fastener, the third removable fastener, and the fourth removable fastener is removable using a screw tool.

6. The packable stringed instrument of claim 4, wherein the rear face panel of the UB portion is removably secured to the central body portion by at least a fifth removable fastener, and the rear face panel of the LB portion is removably secured to the central body portion by at least a sixth removable fastener.

7. The packable stringed instrument of claim 5, wherein the central body portion further includes an upper lip and a lower lip, wherein the upper lip is connected to the central rear face panel and extends away from the central rear face panel towards the UB portion, the bottom lip is connected to the central rear face panel and extends away from the central rear face panel towards the LB portion, the fifth removable fastener is connected through a second aperture in the rear face panel of the UB portion from the rear face panel of the UB portion to the upper lip of the central body portion, and the sixth removable fastener is connected through a second aperture in the rear face panel of the LB portion from the rear face panel of the LB portion to the lower lip of the central body portion.

8. The packable stringed instrument of claim 1, further comprising at least one string, a tailpiece, and a stand, wherein the packable stringed instrument is an upright bass, the UB portion, LB portion, and central body portion together define a hollow interior of the body portion, the LB portion includes a stand aperture, the stand extends through the stand aperture from the hollow interior of the body portion to an exterior of the upright bass, the string includes a first end and a second end, wherein the first end of the string is connected to the head portion and the second end of the string is connected to the tailpiece, and the tailpiece includes a string retaining saddle strap, wherein the string retaining saddle strap is connected to the stand and the tailpiece is removably secured to the body portion by a tension that is created by the string and the string retaining saddle strap.

9. The packable stringed instrument of claim 7, wherein the head portion is connected to the neck portion by a tension that is generated by the string.

10. The packable stringed instrument of claim 1, wherein the neck portion is removably connected to the head portion by at least one removable fastener.

11. A packable stringed instrument, comprising:

a head portion;

a segmented body portion, wherein the segmented body portion includes at least a first segment, a second segment, and a central body portion, wherein the central body portion is positioned between the first segment and the second segment; and, a neck portion positioned between the head portion and the segmented body portion, wherein the neck portion includes a first end and a second end, wherein the first end of the neck portion is connected to the head portion, and the second end of the neck portion is connected to the segmented body portion; and, a plurality of removable fasteners, wherein at least one removable fastener removably secures the first segment of the body portion to the central body portion, and at least one removable fastener removably secures the second segment of the body portion to the central body portion.

12. The packable stringed instrument of claim 11, wherein the first segment, the second segment, and the central body portion are separable from each other.

13. The packable stringed instrument of claim 11, wherein one or more portions of each of the central body portion, the first segment, and the second segment are complimentarily shaped so as to be stackable in a disassembled state.

14. A method for disassembling a packable stringed instrument, comprising:

removing a tailpiece from a body portion of the stringed instrument;

removing a neck portion of the stringed instrument from the body portion of the stringed instrument;

removing a head portion of the stringed instrument from the neck portion; and, removing from each other at least an upper body (UB) segment of the body portion, a lower body (LB) segment of the body portion, and a central body portion.

15. The method of claim 14, wherein removing the tailpiece from the body portion includes releasing a strap, wherein the packable stringed instrument is an upright bass, the strap includes a first end and a second end, wherein the first end of the strap is connected to the tailpiece and the second end of the strap is connected to an upright bass stand, and releasing the strap includes disconnecting the strap from the stand.

16. The method of claim 14, wherein the neck portion further includes a first end and a second end, wherein the first end of the neck portion is connected to the head portion, and the second end of the neck portion is connected to the body portion, the neck portion further includes a heel extending away from the neck portion in a direction that is substantially perpendicular to a direction from the first end of the neck portion to the second end of the neck portion;

the second end of the neck portion is connected to the body portion by a set screw, and removing the neck portion from the body portion includes disengaging the set screw from the second end of the neck portion.

17. The method of claim 16, wherein disengaging the set screw includes rotating the set screw in a disengaging direction with a screw tool.

18. The method of claim 14, wherein removing the head portion from the neck portion includes removing a fastener that connects the head portion to the neck portion.

19. The method of claim 14, wherein the stringed instrument includes at least one string, the string includes a first end and a second end, wherein the first end of the string is connected to the head portion and the second end of the string is connected to the tailpiece, and removing the head portion from the neck portion includes releasing a tension that is generated by the string.

20. The method of claim 14, wherein removing from each other the UB segment, the LB segment, and the central body portion includes removing a plurality of fasteners that respectively connect the UB segment to the central body portion and the LB segment to the central body portion.

* * * * *